US011795016B2

(12) United States Patent
Maeda et al.

(10) Patent No.: US 11,795,016 B2
(45) Date of Patent: Oct. 24, 2023

(54) SHEET-SHAPED-MEDIUM FEEDER AND SHEET-SHAPED-MEDIUM HANDLING APPARATUS

(71) Applicant: FUJIFILM Business Innovation Corp., Tokyo (JP)

(72) Inventors: Shoichi Maeda, Kanagawa (JP); Teruki Naganuma, Kanagawa (JP); Masahito Niwa, Kanagawa (JP); Yuichi Araki, Kanagawa (JP); Yoshiki Kimura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 109 days.

(21) Appl. No.: 17/225,132

(22) Filed: Apr. 8, 2021

(65) Prior Publication Data

US 2022/0081237 A1 Mar. 17, 2022

(30) Foreign Application Priority Data

Sep. 11, 2020 (JP) ..... 2020-153047

(51) Int. Cl.
*B65H 3/48* (2006.01)
*B65H 3/14* (2006.01)

(52) U.S. Cl.
CPC ..... *B65H 3/48* (2013.01); *B65H 3/14* (2013.01); *B65H 2405/15* (2013.01); *B65H 2511/11* (2013.01); *B65H 2701/11312* (2013.01)

(58) Field of Classification Search
CPC ... B65H 1/04; B65H 1/14; B65H 1/26; B65H 3/48; B65H 2405/1116; B65H 2405/11164; B65H 2405/114; B65H 2405/15; B65H 2511/11; B65H 2701/11312
See application file for complete search history.

(56) References Cited

U.S. PATENT DOCUMENTS

| | | | | |
|---|---|---|---|---|
| 9,359,157 | B2 | 6/2016 | Niikura et al. | |
| 2012/0299236 | A1* | 11/2012 | Fujita | B65H 1/14 271/96 |
| 2019/0233226 | A1* | 8/2019 | Nakamura | B65H 3/48 |
| 2021/0061596 | A1* | 3/2021 | Kimura | B65H 3/06 |

FOREIGN PATENT DOCUMENTS

| | | |
|---|---|---|
| JP | 6384275 | 9/2018 |

* cited by examiner

*Primary Examiner* — Prasad V Gokhale
(74) *Attorney, Agent, or Firm* — JCIPRNET

(57) ABSTRACT

A sheet-shaped-medium feeder includes a housing, a mount portion that is disposed to be vertically movable in the housing and that receives sheet-shaped media, a lift that vertically raises or lowers the mount portion, a discharger that transports the sheet-shaped media stacked on the mount portion in order from an upper one of the sheet-shaped media, and first air outlets that blow air to the sheet-shaped media stacked on the mount portion at left and right edges in a feed width of the sheet-shaped media. The mount portion is changeable to a long mount portion capable of receiving long sheet-shaped media by extending an end portion of the mount portion upstream from an unchanged position in a transportation direction of the sheet-shaped media, the end portion corresponding to an upstream end portion in the transportation direction. The sheet-shaped-medium feeder has a second air outlet that blows air to at least one of left and right edges of the long sheet-shaped media stacked on the extended portion of the long mount portion.

16 Claims, 19 Drawing Sheets

SHEET-SHAPED-MEDIUM FEEDER AND SHEET-SHAPED-MEDIUM HANDLING APPARATUS

CROSS-REFERENCE TO RELATED APPLICATIONS

This application is based on and claims priority under 35 USC 119 from Japanese Patent Application No. 2020-153047 filed Sep. 11, 2020.

BACKGROUND

(i) Technical Field

The present disclosure relates to a sheet-shaped-medium feeder and a sheet-shaped-medium handling apparatus.

(ii) Related Art

Existing examples of a feeder capable of feeding a long sheet-shaped medium such as a long sheet with a size longer than an ordinary-sized sheet such as an A4 or A3 sheet include a sheet feeder described in Japanese Patent No. 6384275 (for example, see Claim 1, paragraphs 0010 and 0022, and FIGS. 3 to 7).

Japanese Patent No. 6384275 (for example, see Claim 1, paragraphs 0010 and 0022, and FIGS. 3 to 7) describes a sheet feeder including a tray bottom board, serving as a mount board that receives sheets, and a long-size option that includes an extension bottom board, serving as an extension board formed to extend the tray bottom board upstream in a sheet transportation direction to allow long sheets to be stacked thereon. The long-size option includes the extension bottom board, a long-size base fixed to the housing, and an open-close covering.

SUMMARY

Aspects of non-limiting embodiments of the present disclosure relate to a sheet-like-article feeder and a sheet-shaped-medium handling apparatus including a sheet-shaped-medium mount portion that is vertically raised or lowered by a lift. When the sheet-shaped-medium mount portion is extended upstream in a transportation direction of the sheet-shaped media to be formed into a long mount portion capable of receiving long sheet-shaped media, the feeder allows the stacked long sheet-shaped medium to be more efficiently separable up to an upstream end of the long sheet-shaped media in a transportation direction, than in a case where the mount portion has no second air outlet that blows air to at least one of left and right edges of the long sheet-shaped media stacked on the extended portion of the long mount portion.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a sheet-shaped-medium feeder according to an aspect of the disclosure that includes A sheet-shaped-medium feeder includes a housing, a mount portion that is disposed to be vertically movable in the housing and that receives sheet-shaped media, a lift that vertically raises or lowers the mount portion, a discharger that transports the sheet-shaped media stacked on the mount portion in order from an upper one of the sheet-shaped media, and first air outlets that blow air to the sheet-shaped media stacked on the mount portion at left and right edges in a feed width of the sheet-shaped media. The mount portion is changeable to a long mount portion capable of receiving long sheet-shaped media by extending an end portion of the mount portion upstream from an unchanged position in a transportation direction of the sheet-shaped media, the end portion corresponding to an upstream end portion in the transportation direction. The sheet-shaped-medium feeder has a second air outlet that blows air to at least one of left and right edges of the long sheet-shaped media stacked on the extended portion of the long mount portion.

BRIEF DESCRIPTION OF THE DRAWINGS

Exemplary embodiments of the present disclosure will be described in detail based on the following figures, wherein.

18B is a schematic plan view of a lift and second air outlets in the feeder illustrated in FIG. 18A.

DETAILED DESCRIPTION

Exemplary embodiments of the present disclosure will be described below with reference to the drawings.

First Exemplary Embodiment

Figure 1:
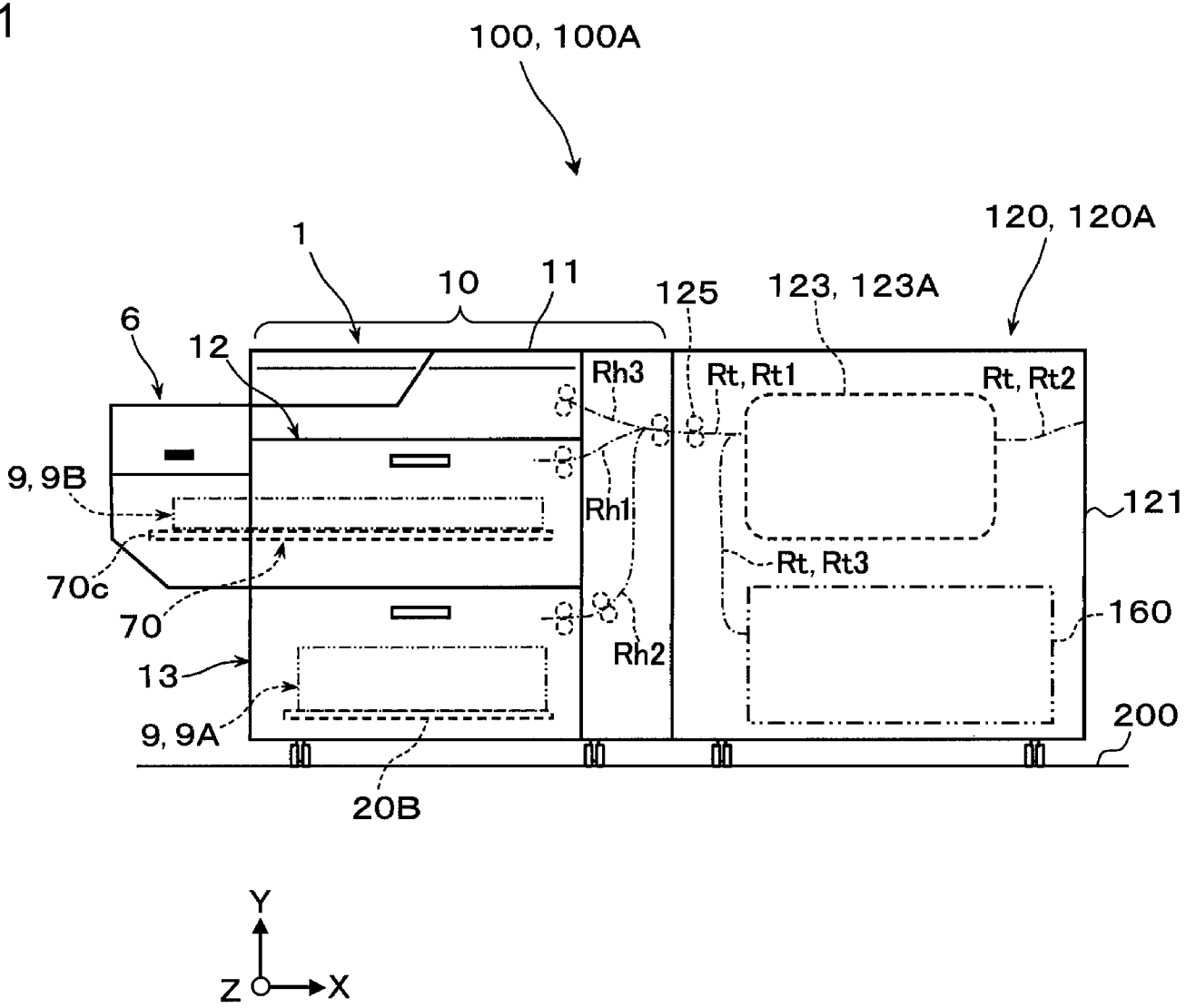
FIG. 1 is a side view of a sheet-shaped-medium handling apparatus according to a first exemplary embodiment.
Figure 2:
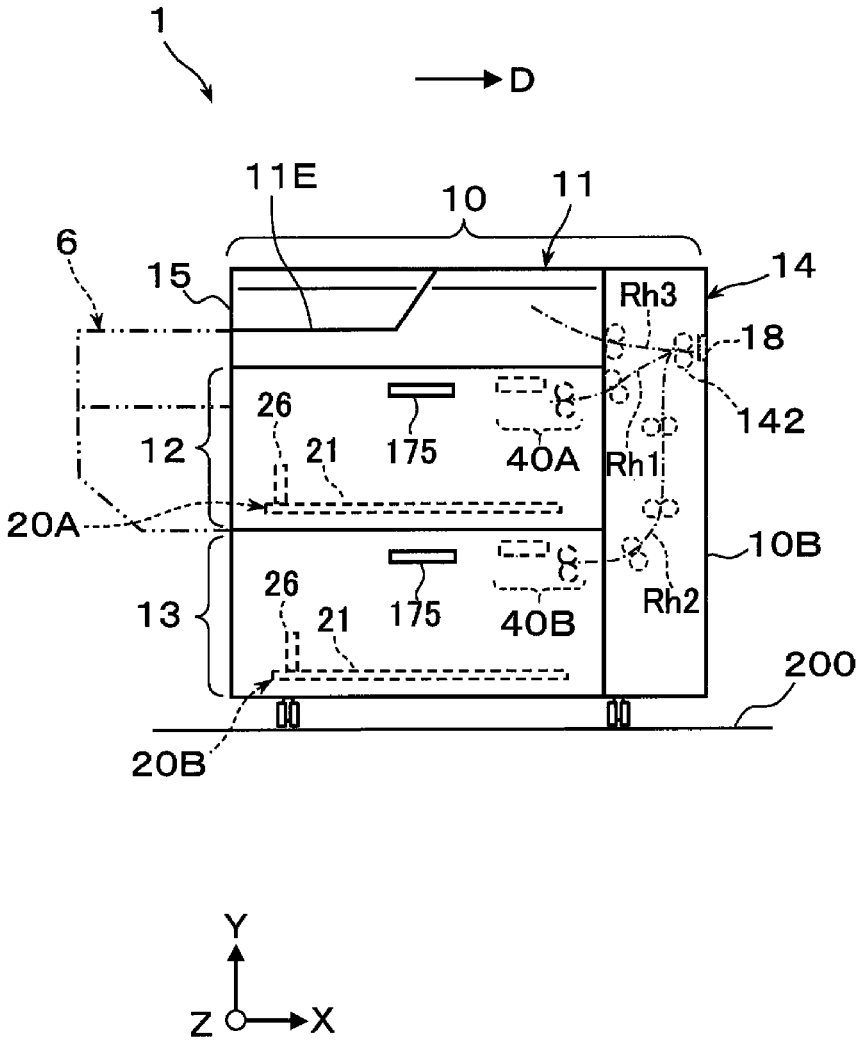
FIG. 2 is a side view of a sheet-shaped-medium feeder according to the first exemplary embodiment.

FIG. 1 illustrates a sheet-shaped-medium handling apparatus 100 according to a first exemplary embodiment of the present disclosure. FIG. 2 illustrates a sheet-shaped-medium feeder 1 according to the first exemplary embodiment.

In the following description, throughout the drawings, the direction indicated with arrow X is referred to as a width direction, the direction indicated with arrow Y is referred to as a height direction, and the direction indicated with arrow Z is referred to as an apparatus depth direction perpendicular to the width direction and the height direction. A circle in the drawings at the intersection of the arrow X and the arrow Y denotes the apparatus depth direction (arrow Z) directing downward of the drawing sheet, or perpendicular to the drawing sheet.

Sheet-Shaped-Medium Handling Apparatus

As illustrated in FIG. 1, the sheet-shaped-medium handling apparatus 100 includes the sheet-shaped-medium feeder 1, which transports and feeds sheet-shaped media 9 stacked thereon, and a processing device 120, which performs processing on the sheet-shaped media 9 fed from the feeder 1.

The sheet-shaped media 9 are sheet-like media that are receivable in and transportable by the feeder 1 and transportable and processible by the processing device 120. An image forming system 100A and other portions are installed on an installation surface 200 illustrated in FIG. 1.

The sheet-shaped-medium handling apparatus 100 according to the first exemplary embodiment includes an image forming apparatus 120A that forms images on the sheet-shaped media 9 to serve as the processing device 120. The processing device 120 is connected to and combined with the feeder 1 to form the image forming system 100A.

In the first exemplary embodiment, examples used as the sheet-shaped media 9 include recording media that allow images to be formed thereon, such as sheets, coated paper, films, foil, and sheet-like cloth cut into predetermined sizes.

As illustrated in FIG. 1, the image forming apparatus 120A, serving as an example of the processing device 120, includes an image forming unit 123A and a transport path Rt inside a housing 121 with a predetermined profile. The image forming unit 123A forms images on the sheet-shaped media 9 and serves as an example of a processing unit 123. The transport path Rt allows the sheet-shaped media 9 to be transported along itself inside the housing 121.

The image forming unit 123A has, for example, an image forming system such as an electrophotographic system or an inkjet recording system. However, the image forming system, layout, the number of units, and other details are not limited to particular ones. An introduction transport path Rt1 indicated with a dot-and-dash line in FIG. 1 allows the sheet-shaped media 9 fed from the feeder 1 to be transported along itself and introduced into the image forming unit 123A. The introduction transport path Rt1 includes transport rollers 125, and a transport guide. A discharge transport path Rt2 indicated with a dot-and-dash line allows the sheet-shaped media 9 that have passed the image forming unit 123A to be transported along itself and discharged to a receiving portion or a post-processing unit, not illustrated. The discharge transport path Rt2 includes transport rollers and a transport guide, not illustrated.

In the image forming system 100A, when the sheet-shaped media 9 are fed from the feeder 1 to the image forming apparatus 120A, which is an example of the processing device 120, the image forming apparatus 120A forms images on the fed sheet-shaped media 9. Forming images is an example of processing performed on the sheet-shaped media 9.

As indicated with a chain double-dashed line in FIG. 1, the image forming apparatus 120A may include, inside the housing 121, a sheet-shaped-medium internal feeding unit 160 that accommodates the sheet-shaped media 9 and feeds the sheet-shaped media 9 to the image forming unit 123A. When including the internal feeding unit 160, the image forming apparatus 120A includes a second introduction transport path Rt3 disposed to connect the internal feeding unit 160 and the image forming unit 123A. The image forming apparatus 120A including the internal feeding unit 160 is also usable by being combined with the sheet-shaped-medium feeder 1 serving as an external feeding unit.

Sheet-Shaped-Medium Feeder

As illustrated in FIGS. 1 and 2, the sheet-shaped-medium feeder 1 includes a housing 10 that is a body accommodating and feeding the sheet-shaped media 9.

The feeder 1 allows an additional device 6 to be retrofitted thereto on a side portion 10S of the housing 10. The additional device 6 allows long sheet-shaped media 9B to be stacked thereon to accommodate the long sheet-shaped media 9B.

Here, the long sheet-shaped media 9B are media longer than normal sheet-shaped media 9A with a normal length stackable and receivable in the housing 10 (length in the transportation direction D or feed length, described below). The normal length here is a length handleable inside the housing 10 (specifically, stacked on a mount portion 20A, described below), which is a length of, for example, equal to or smaller than 488 mm.

Body of Feeder

The housing 10 includes a support frame forming a predetermined skeleton structure, and an exterior panel forming the appearance. As illustrated in the drawings such as FIGS. 1 to 4, the housing 10 roughly includes an upper portion 11, feed units 12 and 13 located below the upper portion 11 and vertically stacked one on the other (upper and lower units), and a discharge portion 14 disposed at an end of the upper portion 11 and the feed units 12 and 13 on one side.

The upper portion 11 in the housing 10 includes an open-close member 15 at a portion of the upper surface away from the side where the discharge portion 14 is disposed. The open-close member 15 opens or closes a mount space S1 in the feed unit 12 on the upper side.

Figure 3:
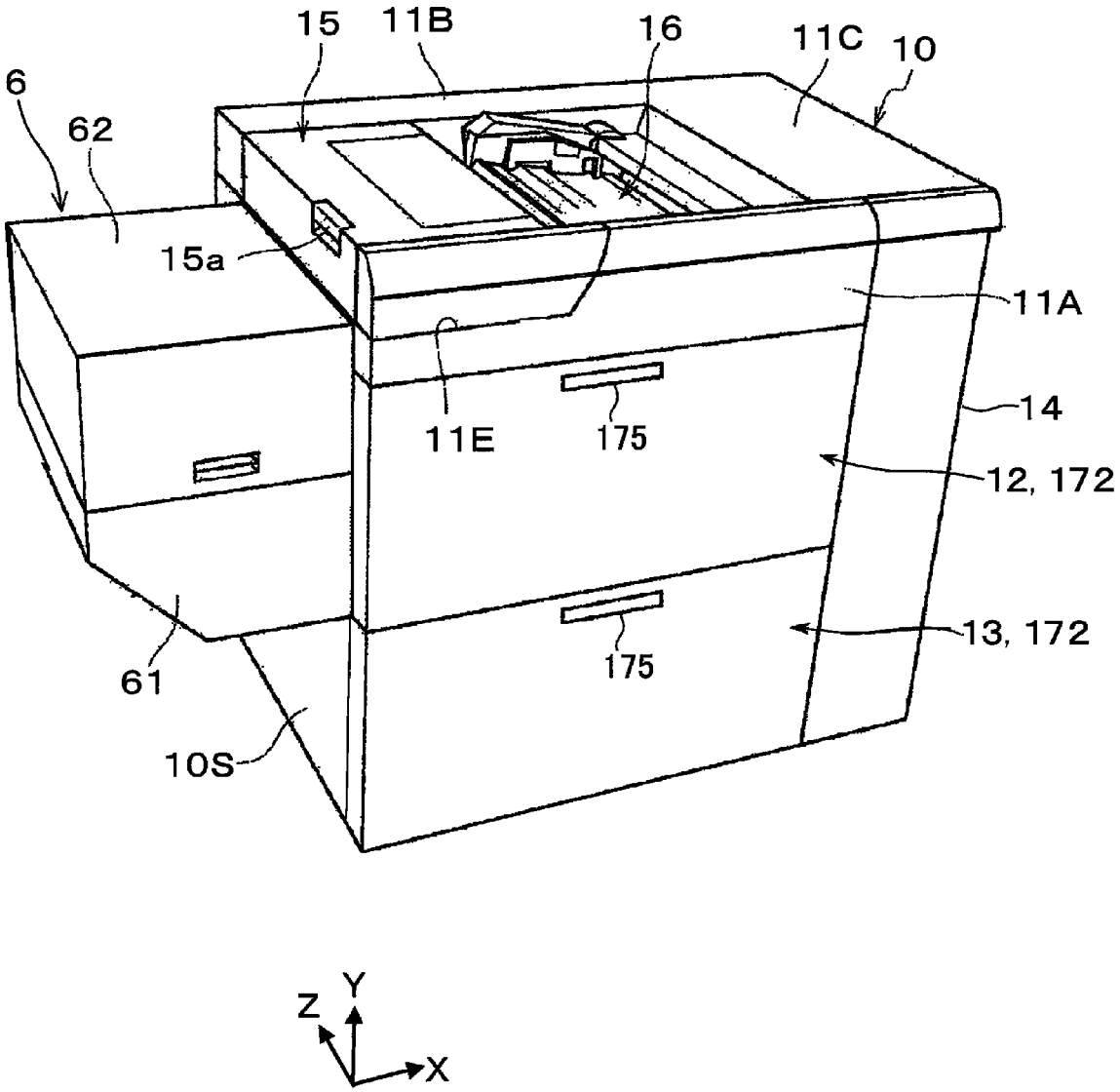
FIG. 3 is a perspective view of the feeder illustrated in FIG. 2 to which an additional device is retrofitted.
Figure 4:
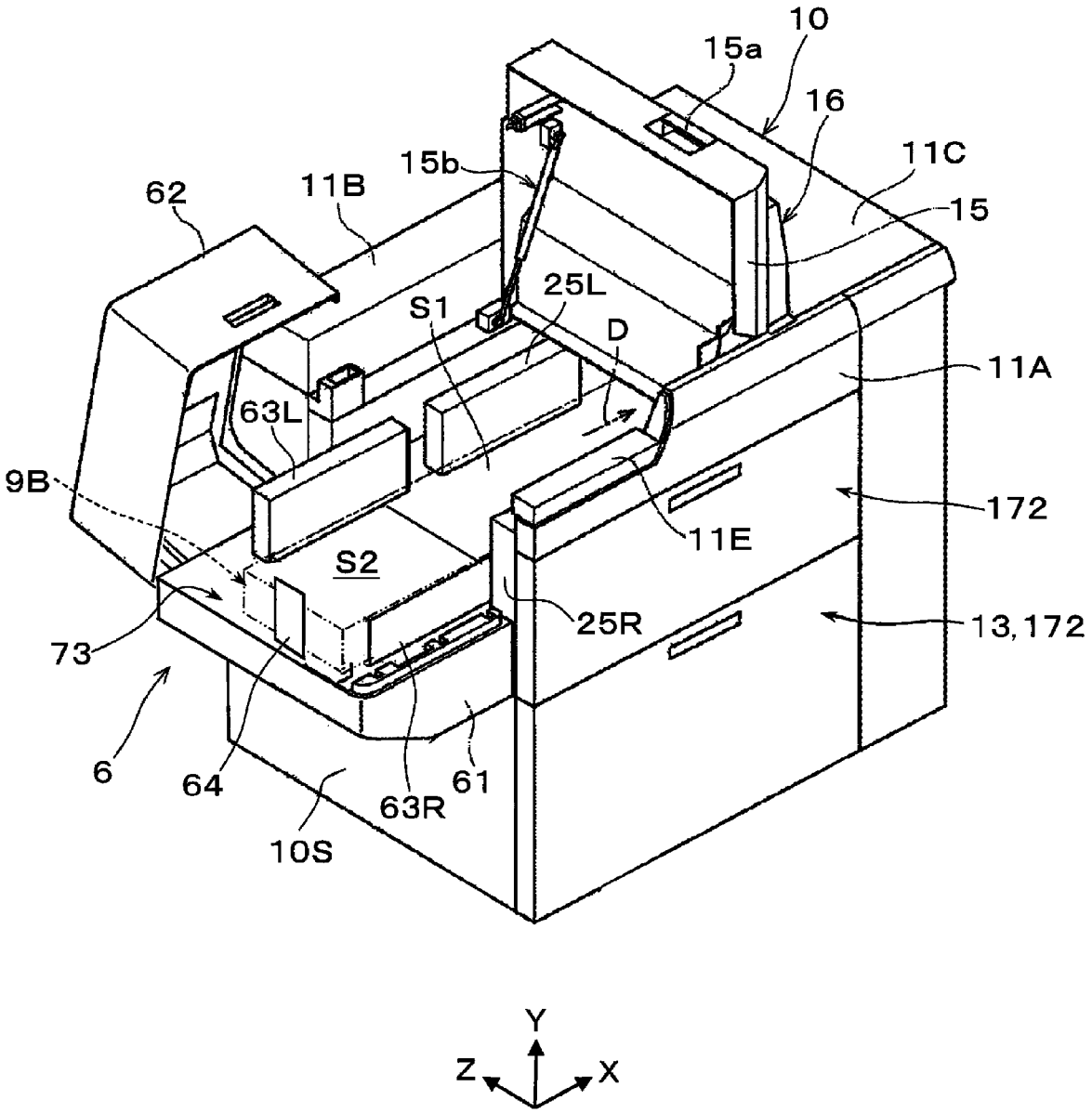
FIG. 4 is a perspective view of an open-close portion and an open-close member of the feeder illustrated in FIG. 3 in an open state.

The open-close member 15 vertically swings open or closed on a hinge disposed at the end closer to the side where the discharge portion 14 is disposed. The open-close member 15 includes a handle 15*a* at the end opposite to the end closer to the side where the discharge portion 14 is disposed. The handle 15*a* unlocks the open-close member 15 in the closed state (FIG. 3). Thus, when the open-close member 15 is raised upward with the handle 15*a* being gripped, a latch mechanism not illustrated is unlocked and the open-close member 15 is opened (FIG. 4). A damper 15*b* illustrated in FIG. 4 supports the operation of opening the open-close member 15 and keeps the open-close member 15 opened.

As illustrated in FIG. 3 and other drawings, the open-close member 15 is surrounded by a front wall 11A, a rear wall 11B, and an upper surface portion 11C, forming the upper portion 11. The upper surface portion 11C is disposed between the front wall 11A and the rear wall 11B. A portion of the front wall 11A that is to overlap the closed open-close member 15 forms a cut portion 11E cut downward to further expose the mount space S1 to the outside. The open-close member 15 also has a manual feed unit 16, which receives and feeds the normal sheet-shaped media 9A for manual feeding.

As illustrated in FIGS. 2, 5, 7, and 8 and other drawings, the feed unit 12 on the upper side and the feed unit 13 on the lower side in the housing 10 include containers 17A and 17B, such as trays, mount portions 20A and 20B that receive the normal sheet-shaped media 9A (FIG. 1), a lift 30 that vertically raises and lowers the mount portions 20A and 20B inside the containers 17A and 17B, and dischargers 40A and 40B that discharge the normal sheet-shaped media 9A respectively stacked on the mount portions 20A and 20B toward the discharge portion 14 in the direction of arrow D (in the transportation direction D).

The containers 17A and 17B are attached to be drawable to the near side (upstream side in the apparatus depth direction Z) of the housing 10. The containers 17A and 17B each include a body 170 (FIG. 10), front walls 172, a leading-end wall 173, and a moving device, not illustrated. The body 170 has a rectangular open-top box shape with a side portion open. The front walls 172 are disposed on the near side surface of the body 170. The leading-end wall 173 vertically guides downstream ends of the mount portions 20A and 20B in the transportation direction D, to align the leading ends of the normal sheet-shaped media 9A stacked on the mount portions 20A and 20B for positioning. The leading ends are disposed downstream in the transportation direction D. The moving device includes slide rails and a latch mechanism disposed between the left and right side portions of the body 170 in the pull-out direction and the inner wall of the housing 10.

Figure 10:
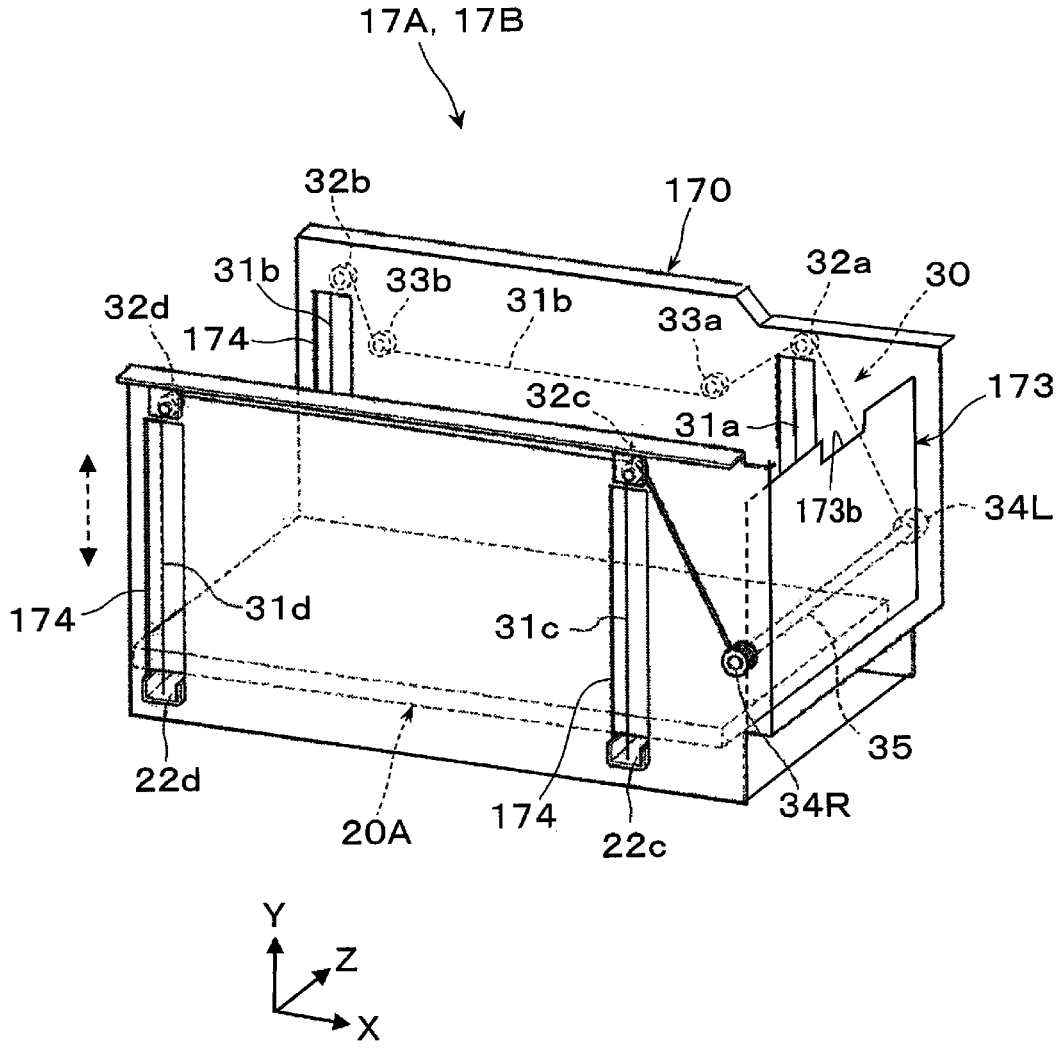
FIG. 10 is a perspective view of a lift and an unchanged mount portion in the feeder illustrated in FIG. 3.

As illustrated in FIG. 10, the leading-end wall 173 has a cut recess 173*b* at the middle at the upper end of the leading-end wall 173. The recess 173*b* enables, for example, checking of existence of the normal sheet-shaped media 9A stacked on the mount portion 20A or 20B.

The containers 17A and 17B each include a pull opening 175 in an upper portion of the corresponding front wall 172, and includes a handle in the pull opening 175. The handle unlocks the containers 17A and 17B stored in the housing 10. The handle is not illustrated. The containers 17A and 17B are thus each drawn out of the housing 10 by being pulled to the near side of the housing 10 while the pull opening 175 and the handle are gripped, and allow the normal sheet-shaped media 9A to be stacked on the mount portions 20A and 20B.

When the additional device 6 is attached to the feeder 1, the pull opening 175 on the front wall 172 of the feed unit 12 on the upper side is blocked to disable the container 17A from being drawn out.

The mount portions 20A and 20B are plate members having a mount surface 21 that receives the normal sheet-shaped media 9A on the upper portion. The mount portions 20A and 20B are disposed to be vertically movable in the containers 17A and 17B.

Figure 9:
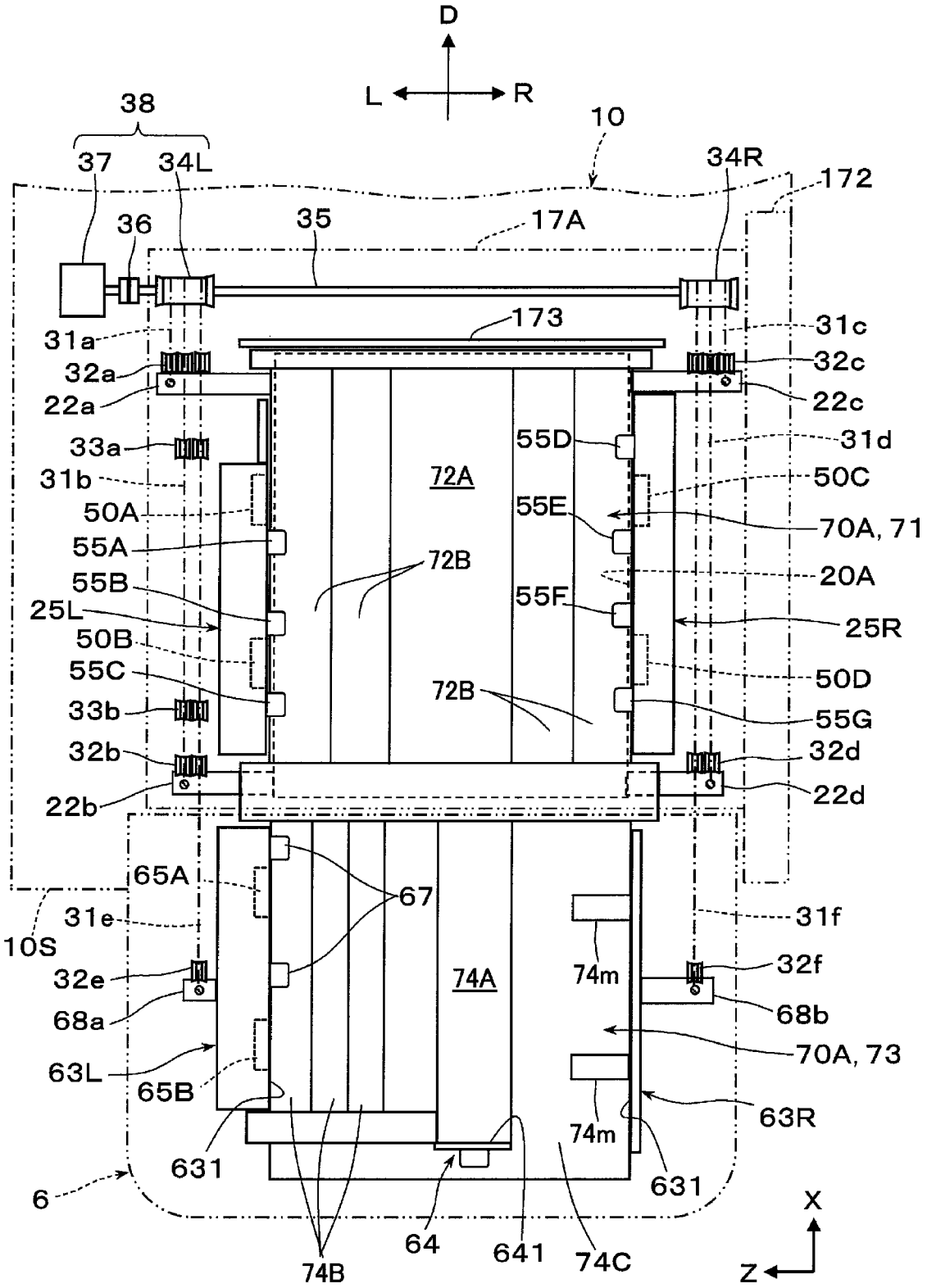
FIG. 9 is a schematic plan view of the long mount portion in the feeder illustrated in FIG. 3 and the surroundings of the mount portion.
Figure 11A:
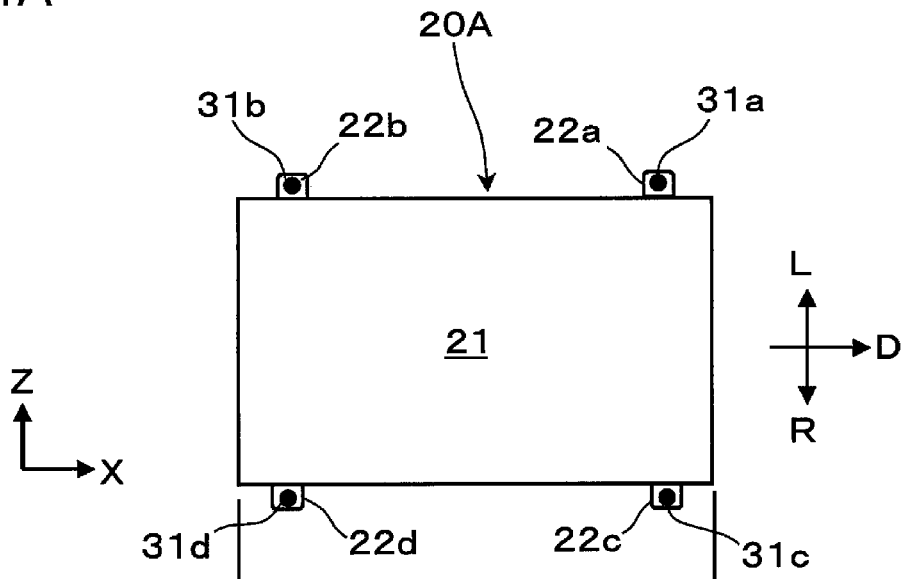
FIG. 11A is a schematic plan view of the unchanged mount portion.

The mount portion 20A among the mount portions 20A and 20B is described as an example. As illustrated in FIGS. 9, 10, and 11A and other drawings, the mount portion 20A includes four hanging portions 22*a*, 22*b*, 22*c*, and 22*d* protruding outward at the left and right edges. The hanging portions 22*a*, 22*b*, 22*c*, and 22*d* are disposed at four positions, that is, two positions in the transportation direction D at each of left and right edges in the left and right directions L and R, where the left and right directions L and R cross the transportation direction D in which the normal sheet-shaped media 9A on the mount portion 20A are discharged by the discharger 40A.

In the first exemplary embodiment, the right direction R is on the near side (front side) of the apparatus, and the left direction L is on the far side (rear side) of the apparatus.

Figure 7:
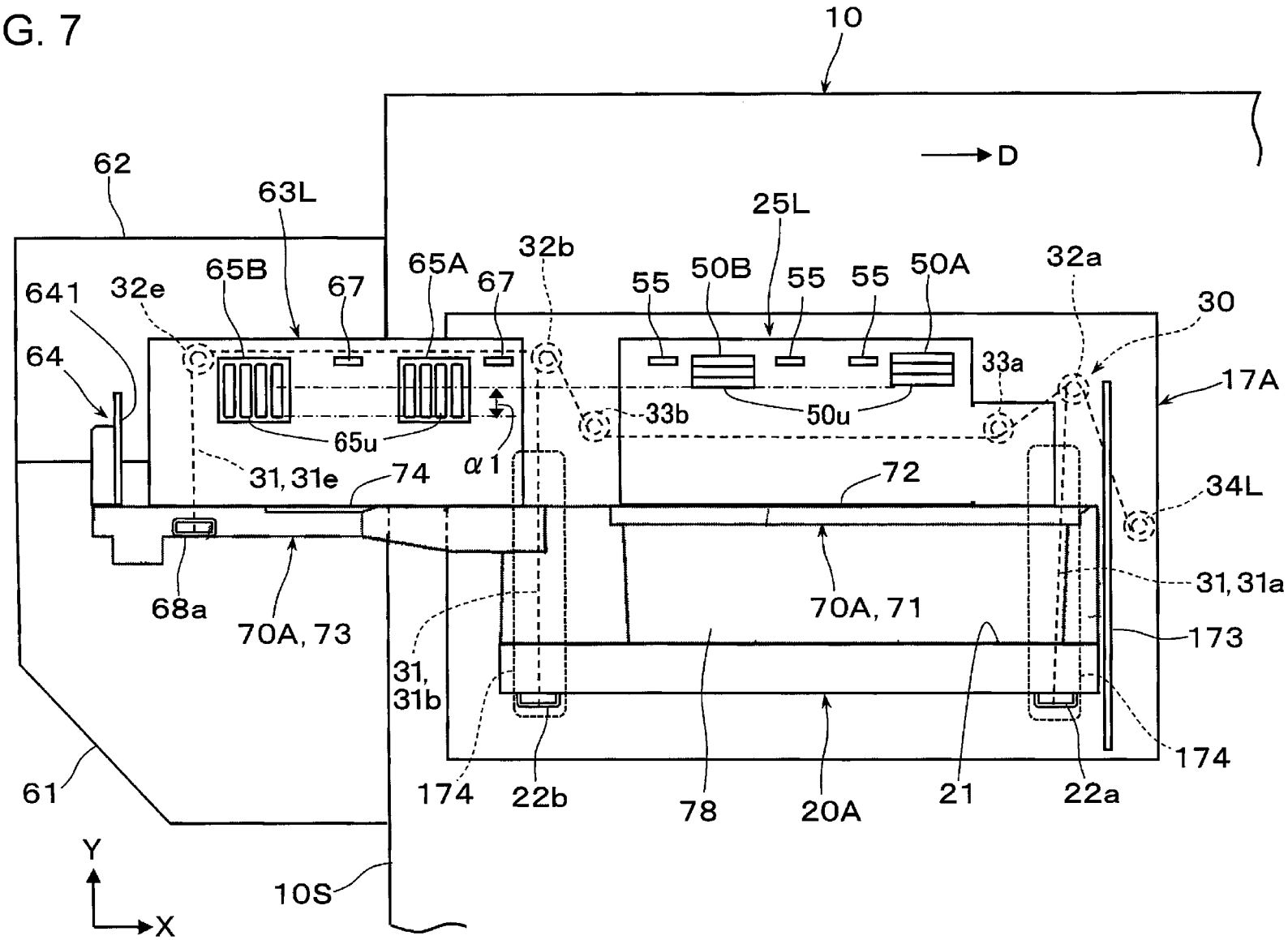
FIG. 7 is a partially enlarged side view of the feeder illustrated in FIG. 5.
Figure 8:
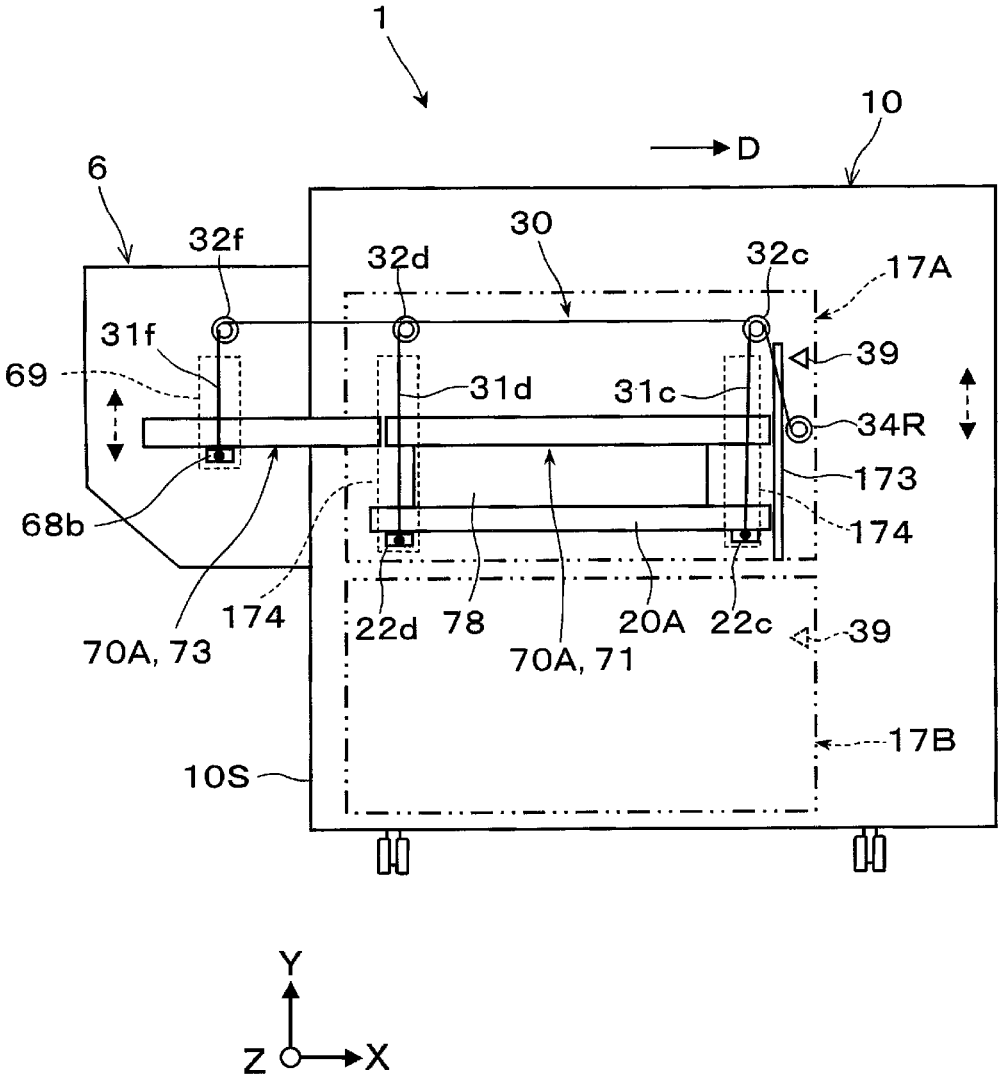
FIG. 8 is a side view including a lift and the long mount portion in the feeder illustrated in FIG. 3.

As illustrated in FIGS. 7, 8, and 10 and other drawings, the mount portion 20A is attached while having the hanging portions 22*a*, 22*b*, 22*c*, and 22*d* fitted, from the inner side of the container 17A, into four guide holes 174 in the near and far side walls of the body 170 of the container 17A. The guide holes 174 are, for example, rectangular openings linearly extending through by a predetermined length in the vertical direction (in the apparatus height direction Y) indicated with a broken double-pointed arrow (FIG. 10).

Thus, the mount portion 20A is vertically movable in the body 170 of the container 17A while having the hanging portions 22*a*, 22*b*, 22*c*, and 22*d* being guided along the guide holes 174. The mount portion 20A is movable by a length of the guide holes 174 in the vertical direction.

The mount portion 20B also has a structure substantially similar to the above structure relating to the vertical movement of the mount portion 20A. Instead of long through-holes, the guide holes 174 may be guide grooves extending linearly.

Figure 6:
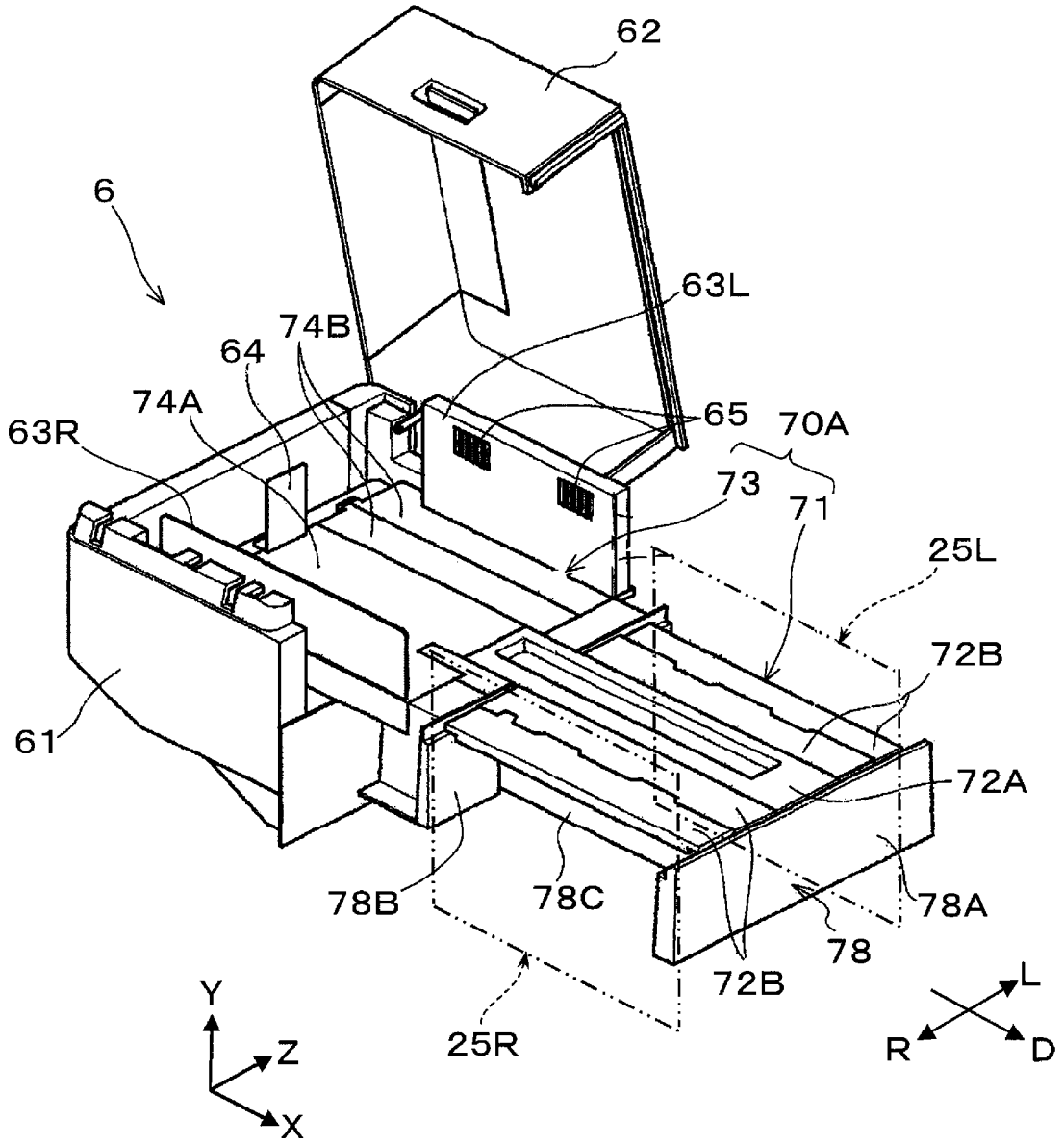
FIG. 6 is a rough perspective view of a long mount portion in an additional device and the feeder illustrated in FIG. 3.

As illustrated in FIGS. 2, 4, and 6 and other drawings, the mount portions 20A and 20B each include left and right side walls 25L and 25R and a rear end wall 26. The left and right side walls 25L and 25R come into contact with left and right edges of the normal sheet-shaped media 9A stacked on the corresponding mount surface 21 to guide the left and right edges in the transportation direction D. The rear end wall 26 aligns the trailing ends of the normal sheet-shaped media 9A, on the upstream side in the transportation direction D, to fix the position of the trailing ends.

The side walls 25L and 25R each include a contact surface 251 (FIG. 5) that comes into contact with the left or right edges of the normal sheet-shaped media 9A. The entirety of the contact surface 251 is movable in the left and right directions L and R over the bottom portion of the body 170 of the container 17A or 17B. Thus, the side walls 25L and 25R are moved to the positions corresponding to the positions of the left and right edges of the sheet-shaped media 9A for adjustment.

The rear end wall 26 has a contact surface that comes into contact with the trailing ends of the normal sheet-shaped media 9A. The entirety of the contact surface is movable with respect to slide grooves, extending in the transportation direction D and formed in a fixed surface portion of the mount surface 21. Thus, the rear end wall 26 is moved to the position corresponding to the position of the trailing ends of the sheet-shaped media 9A for adjustment. The rear end wall 26 is retracted and stored in a predetermined portion (such as a raised portion 78, described below) when the additional device 6 is to be attached.

The mount portions 20A and 20B each have the mount surface 21 having the following two surface structures in accordance with the movement structures of the side walls 25L and 25R.

Specifically, the mount surface 21 includes a fixed surface portion and multiple slide surface portions. The fixed surface portion is fixed at the middle position in the left and right directions L and R to extend in the transportation direction D. The slide surface portions are disposed on the left and right sides of the fixed surface portion to be slidable in the left and right directions L and R in accordance with the movement of the side walls 25L and 25R. The surface structure of the mount surface 21 in each of the mount portions 20A and 20B is also employed in a mount surface 72 of a dedicated mount portion 71 of a long mount portion 70A, described later (FIG. 6 or 9).

Figure 5:
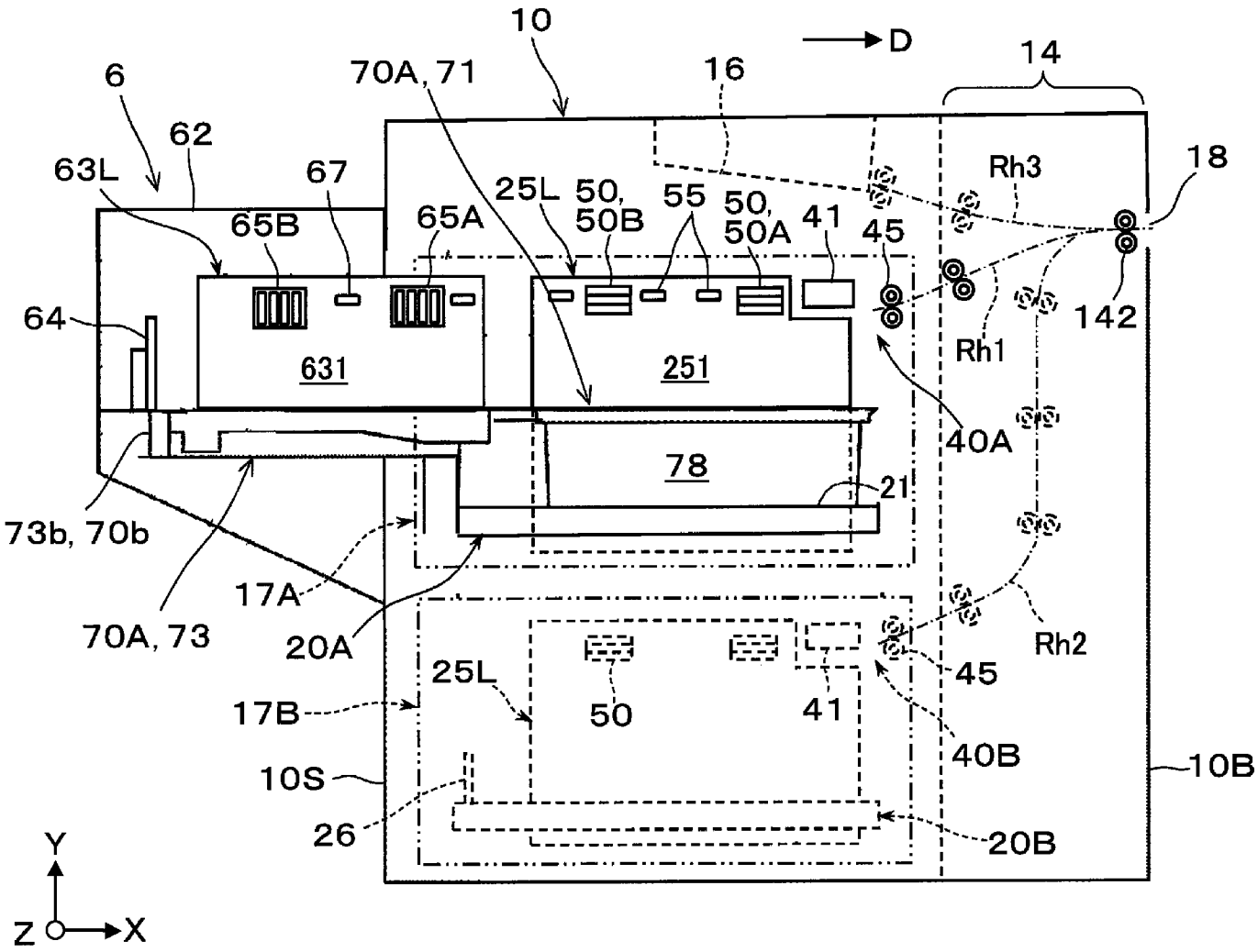
FIG. 5 is a schematic side view of part of the inside of the feeder illustrated in FIG. 3.

As illustrated in FIG. 5 and other drawings, the side walls 25L and 25R each include first air outlets 50 in the contact surface 251. The first air outlets 50 blow air to the left and right edges of the normal sheet-shaped media 9A stacked on the mount portions 20A and 20B.

In the first exemplary embodiment, as illustrated in FIG. 9, the left side wall 25L has two first air outlets 50A and 50B spaced apart in the transportation direction D, and the right side wall 25R has two first air outlets 50C and 50D spaced apart in the transportation direction D. The positions of the first air outlets 50A and 50B in the transportation direction D respectively oppose the positions of the first air outlets 50C and 50D in the transportation direction D.

The first air outlets 50A and 50B are connected to a fan duct including a built-in fan disposed out of the left side wall 25L (on the side opposite to the contact surface 251). The fan is not illustrated. The first air outlets 50C and 50D are connected to a fan duct including a built-in fan disposed out of the right side wall 25R (on the side opposite to the contact surface 251). The fan is not illustrated.

In the feed units 12 and 13, air is blown from the first air outlets 50A, 50B, 50C, and 50D to and between the left and right edges of upper ones of the normal sheet-shaped media 9A stacked on the mount portions 20A and 20B, to cause upper ones of the sheet-shaped media 9A to float in the air and vertically separate from each other.

As illustrated in FIG. 5 and other drawings, the side walls 25L and 25R each include multiple height limiters 55 on the contact surface 251. The height limiters 55 come into contact with the upper surfaces of the left and right edge portions of the normal sheet-shaped media 9A stacked on the mount portions 20A and 20B to limit the upper surfaces to a predetermined height.

In the first exemplary embodiment, as illustrated in FIG. 9, the left side wall 25L has one height limiter 55A disposed upstream from the first air outlet 50A in the transportation direction D, and two height limiters 55B and 55C disposed apart from each other on both sides of, that is, downstream and upstream from the first air outlet 50B in the transportation direction D. The right side wall 25R has two height limiters 55D and 55E disposed apart from each other on both sides of, that is, downstream and upstream from the first air outlet 50C in the transportation direction D, and two height limiters 55F and 55G disposed apart from each other on both sides of, that is, downstream and upstream from the first air outlet 50D in the transportation direction D.

These height limiters 55A to 55G are formed from, for example, plate members protruding by a predetermined length from a predetermined height of the contact surfaces 251 of the side walls 25L and 25R over and above the mount surfaces 21 of the mount portions 20A and 20B. During an operation of stacking the normal sheet-shaped media 9A on the mount surfaces 21 of the mount portions 20A and 20B (when the mount portion 20A and other components are moved to the lowermost position, as will be described below), the height limiters 55A to 55G are, for example, retracted in the side walls 25L and 25R without protruding from the contact surfaces 251.

The feed units 12 and 13 hold from above the left and right edges of the normal sheet-shaped media 9A floated by air blown from the air outlets 50, to keep the normal sheet-shaped media 9A at a predetermined height over the mount surfaces 21 of the mount portions 20A and 20B.

The lift 30 is a device that vertically raises or lowers the mount portions 20A and 20B inside the containers 17A and 17B by hanging the mount portions 20A and 20B with wires 31, serving as an example of line members.

The lift 30 will be described using the mount portion 20A as an example. As illustrated in FIGS. 7 to 10 and other drawings, the lift 30 includes four wires 31*a*, 31*b*, 31*c*, and 31*d* having trailing ends respectively coupled to the hanging portions 22*a*, 22*b*, 22*c*, and 22*d* disposed at four positions of the mount portion 20A.

The lift 30 also includes winding pulleys 32*a*, 32*b*, 32*c*, and 32*d*, a left taking-up pulley 34L, a right taking-up pulley 34R, and auxiliary pulleys 33*a* and 33*b*. The winding pulleys 32*a*, 32*b*, 32*c*, and 32*d* are rotatably attached to portions in the container 17A above the upper ends of the guide holes 174 to have the wires 31*a*, 31*b*, 31*c*, and 31*d* wound therearound. The left taking-up pulley 34L takes up the wires 31*a* and 31*b* disposed on the left. The right taking-up pulley 34R takes up the wires 31*c* and 31*d* disposed on the right. The auxiliary pulleys 33*a* and 33*b* allow the wires 31*a* and 31*b* to be wound therearound so that the wires 31*a* and 31*b* are intendedly routed between the winding pulleys 32*a* and 32*b* and the left taking-up pulley 34L.

As illustrated in FIGS. 9 and 10, the lift 30 connects the left taking-up pulley 34L and the right taking-up pulley 34R with a rotation shaft 35, and connects the end portion of the rotation shaft 35 closer to the left taking-up pulley 34L to a driving device 37 (or a driving shaft thereof) via a detachably connectable coupling mechanism 36. The driving device 37 includes components including a motor and a gear mechanism. In the lift 30, the left taking-up pulley 34L, the right taking-up pulley 34R, and the driving device 37 form a winder 38 that takes up and unwinds the wires 31*a*, 31*b*, 31*c*, and 31*d*.

Figure 12A:
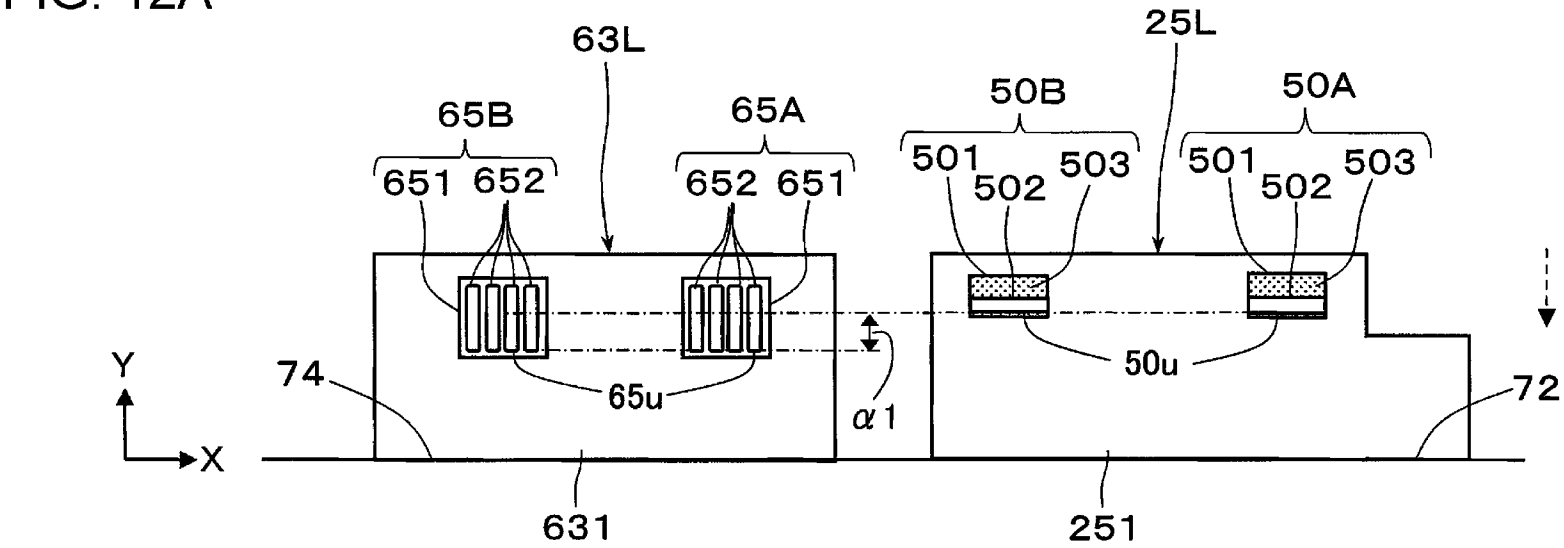
FIGS. 12A and 12B are schematic side view of first air outlets and second air outlets in the feeder illustrated in FIG. 3 in two states.
Figure 12B:
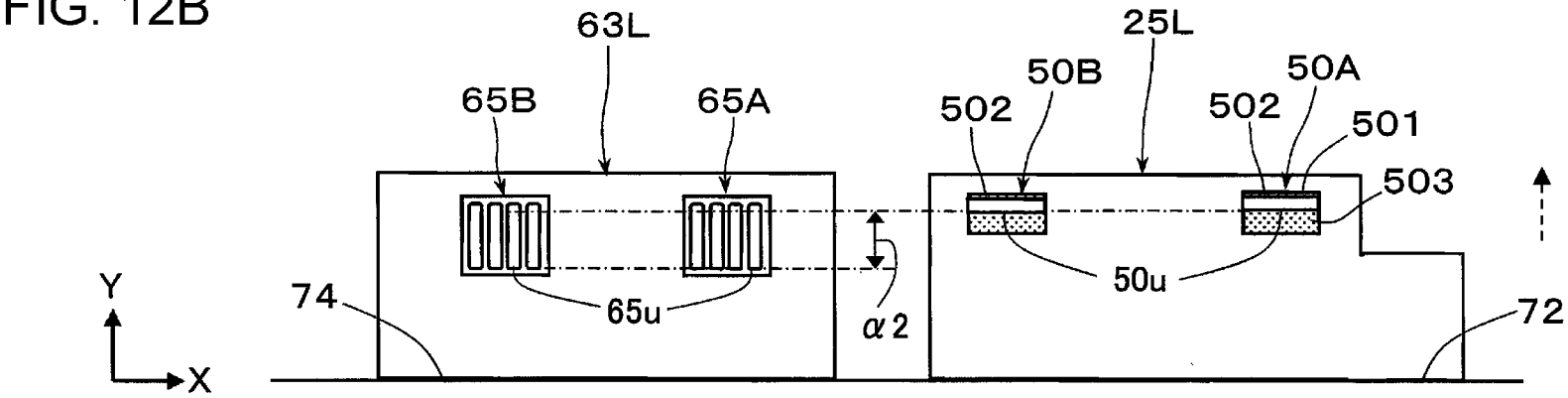

As illustrated in FIGS. 8 and 12A and 12B, the lift 30 in the feed unit 12 includes a position sensor 39 that detects the uppermost position of the normal sheet-shaped media 9A stacked on the mount portion 20A. The position sensor 39 is disposed, for example, to be capable of detecting the uppermost position of the normal sheet-shaped media 9A viewable through the cut recess 173*b* in the leading-end wall 173 of the container 17A.

When the driving device 37 in the lift 30 is driven to take up the wires 31*a*, 31*b*, 31*c*, and 31*d*, the mount portions 20A and 20B move upward, but the driving device 37 is controlled to stop driving upon receipt of detection information from the position sensor 39. Thus, upward movement of the mount portion 20A using the lift 30 is stopped when the uppermost position of the normal sheet-shaped media 9A reaches a predetermined height.

The mount portion 20B in the feed unit 13 on the lower side also includes a lift similar to the lift 30 in the mount portion 20A.

The dischargers 40A and 40B each include a suction portion 41, a transport portion 45, and a guide member, not illustrated. The suction portion 41 sucks the uppermost one of the normal sheet-shaped media 9A stacked on the mount portion 20A or 20B to carry the uppermost medium 9A. The transport portion 45 transports the sheet-shaped medium 9A sucked by the suction portion 41. The guide member forms a first transport path Rh1, described below.

The dischargers 40A and 40B are disposed separately from the containers 17A and 17B while being fixed to the housing 10. Thus, the dischargers 40A and 40B are fixed in position inside the housing 10 without moving regardless of when the containers 17A and 17B are drawn out of the housing 10.

The suction portion 41 is disposed to oppose the mount surface 21 of the mount portion 20A or 20B at the downstream end portion of the container 17A or 17B in the transportation direction D and at an upper portion inward from the leading-end wall 173. The suction portion 41 is disposed upstream from the transport portion 45 in the transportation direction D to reciprocate in the transportation direction D at predetermined timing. Thus, the suction portion 41 is movable toward and away from the transport portion 45 during discharging. The suction portion 41 is connected to an aspiration suction device disposed at the far side of the housing 10. The suction device is not illustrated.

The transport portion 45 is disposed outward from and downstream from the leading-end wall 173 of the container 17A or 17B in the transportation direction D, and downstream from the suction portion 41 in the transportation direction D. The transport portion 45 includes, for example, a pair of transport rollers and a guide member, not illustrated.

As illustrated in FIGS. 1 and 2, the discharge portion 14 in the housing 10 includes the first transport path Rh1, a second transport path Rh2, and a third transport path Rh3. Along the first transport path Rh1, the normal sheet-shaped media 9A are transported outward by the discharger 40A from the feed unit 12 on the upper side. Along the second transport path Rh2, the normal sheet-shaped media 9A are transported outward by the discharger 40B from the feed unit 13 on the lower side. Along the third transport path Rh3, manually fed sheet-shaped media 9 are transported outward from the manual feed unit 16.

The first transport path Rh1, the second transport path Rh2, and the third transport path Rh3 are discharge transport paths extending up to discharge rollers 142 at a discharge port 18 in a side portion 10B of the housing 10 while merging midway. The first transport path Rh1, the second transport path Rh2, and the third transport path Rh3 each include pairs of transport rollers, drawn with broken lines, and a transport guide member not illustrated.

In the feeder 1 not including the additional device 6, to stack the normal sheet-shaped media 9A on the mount portion 20A of the feed unit 12 on the upper side and the mount portion 20B of the feed unit 13 on the lower side, the container 17A and the container 17B are pulled out to the near side of the housing 10 for the stacking operation.

Here, pulling out the container 17A and the container 17B detaches the coupling mechanism 36. Thus, the rotation shaft 35 and the driving device 37 in the lift 30 are disconnected. Thus, the mount portion 20A and the mount portion 20B are lowered by their own weight to their lowermost positions. The lowermost position of the mount portion 20A is, for example, the position where the hanging portions 22*a*, 22*b*, 22*c*, and 22*d* come into contact with the lowest end portions of the guide holes 174.

After the operation of stacking the normal sheet-shaped media 9A is finished, the container 17A and the container 17B are pushed into the housing 10 to be retracted. Thus, the coupling mechanism 36 is coupled again, so that the rotation shaft 35 and the driving device 37 in the lift 30 are coupled.

Feeding Operation of Normal Sheet-Shaped Medium

The sheet-shaped-medium feeder 1 with no additional device 6 retrofitted thereto feeds the normal sheet-shaped media 9A and other media in the following manner.

Specifically, the feed unit 12 on the upper side in the feeder 1 will be described as an example. Inside the container 17A, the mount portion 20A is moved upward by the lift 30 simultaneously taking up the wires 31*a*, 31*b*, 31*c*, and 31*d* until the upper portion of the normal sheet-shaped media 9A stacked on the mount portion 20A reaches the predetermined height.

Subsequently, at the mount portion 20A, air is discharged from the air outlets 50A, 50B, 50C, and 50D in the left and right side walls 25L and 25R, so that upper ones of the normal sheet-shaped media 9A float with air flow and separate from each other. In the container 17A, the leading end portion, in the transportation direction D, of the floating uppermost one of the sheet-shaped media 9A is sucked by receiving a suction force from the suction portion 41 of the discharger 40A.

Subsequently, in the feeder 1, the suction portion 41 of the discharger 40A moves to transport the leading end portion of the sucked one of the sheet-shaped media 9A, disposed downstream in the transportation direction D, to a delivery position where the suction portion 41 passes the leading end portion to the transport portion 45 to deliver the leading end portion to the transport portion 45 (to introduce the leading end portion between a pair of rollers).

Subsequently, the transport portion 45 of the discharger 40A transports the delivered sheet-shaped medium 9A out of the mount portion 20A and the container 17A with a transport force to feed the sheet-shaped medium 9A to the first transport path Rh1. When finishes transporting the sheet-shaped medium 9A to the transport portion 45, the suction portion 41 temporarily stops the suction force and moves to return to the original suction position away from the transport portion 45.

Thus, after the normal sheet-shaped medium 9A is discharged from the feed unit 12 on the upper side through the discharge port 18 via the first transport path Rh1, the normal sheet-shaped medium 9A is fed to the image forming apparatus 120A (the first introduction transport path Rt1 of the image forming apparatus 120A), serving as an example of a destination.

In the feeder 1, in substantially the same manner as in the feeding operation from the feed unit 12 on the upper side, after the normal sheet-shaped media 9A stacked on the mount portion 20B are also discharged from the feed unit 13 on the lower side through the discharge port 18 via the second transport path Rh2, the normal sheet-shaped media 9A are fed to the destination.

Additional Device of Feeder

As illustrated in FIG. 4 and other drawings, the additional device 6 is retrofitted to change the mount portion 20A of the feed unit 12 on the upper side in the housing 10 of the feeder 1 to a long mount portion 70, capable of receiving the long sheet-shaped media 9B, by further extending an end portion 70*c* to the upstream side from an unchanged position in the transportation direction D.

Figure 11B:
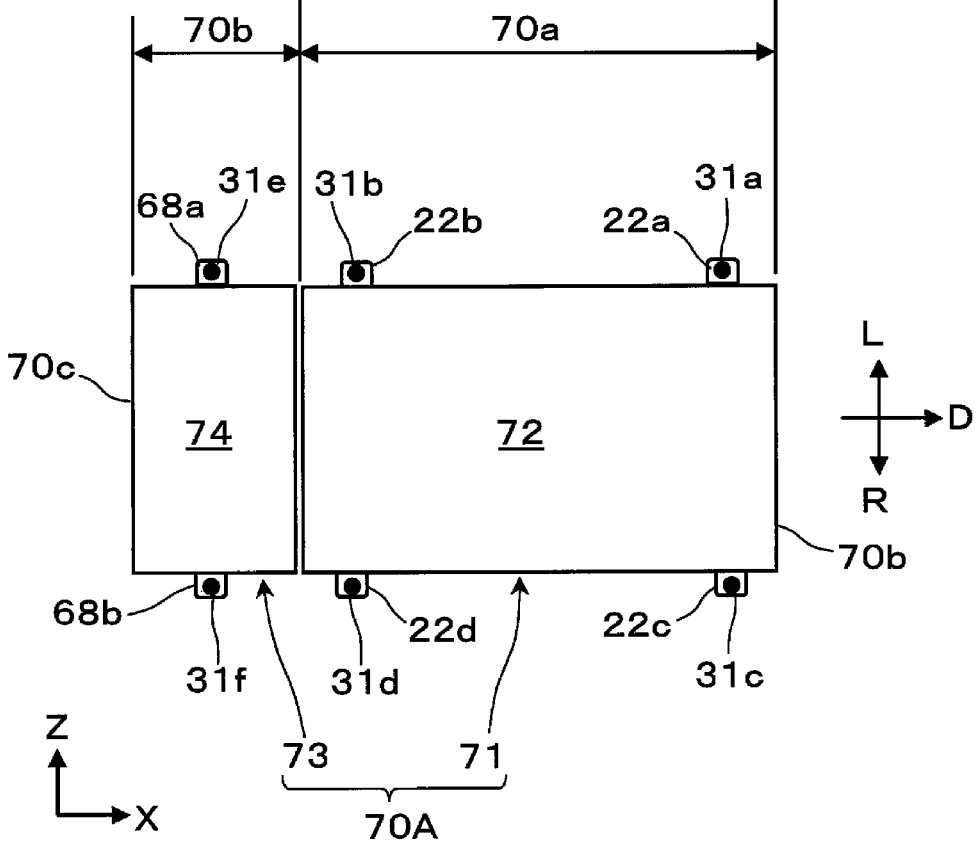
FIG. 11B is a schematic plan view of the long mount portion after change.

As illustrated in FIGS. 5, 7, and 11B and other drawings, in the additional device 6 according to the first exemplary embodiment, at least the end portion 70*c*, upstream in the transportation direction D, of the mount portion 70*b* extended from the unchanged mount portion 70*a* disposed inside the housing 10 is changeable to the long mount portion 70A to serve as the long mount portion 70. The long mount portion 70A protrudes outward from the side portion 10S of the housing 10.

Thus, the additional device 6 is attached to the upper portion of the side portion 10S of the housing 10 of the feeder 1 while protruding outward from the housing 10. The additional device 6 includes a body 61, attached to protrude from the side portion 10S of the housing 10, and an open-close portion 62, disposed above the body 61 to serve as a covering. For example, the additional device 6 is attached after part of an exterior member (panel) at the side portion 10S of the housing 10 is removed.

The body 61 is a portion with a shape having a space for accommodating part (extended part or the mount portion 70*b*) of the long mount portion 70A, and includes a support frame and an exterior member. Part of the support frame is fixed by being screwed on, for example, a support frame disposed on the inner side of the side portion 10S of the housing 10.

As illustrated in FIGS. 4 and 6 and other drawings, the open-close portion 62 is openably attached at the apparatus far side to vertically swing on a hinge, not illustrated, disposed at the far side of the body 61 in the apparatus depth direction Z. When opened, the open-close portion 62 exposes the mount space S2 (FIG. 4) in the mount portion 70*b* (an additional mount portion 73, described later), which is the extended portion of the long mount portion 70A, to allow the long sheet-shaped media 9B to be stacked on the long mount portion 70A.

As illustrated in FIGS. 5 to 9 and 11B, the long mount portion 70A according to the first exemplary embodiment includes a dedicated mount portion 71, disposed inside the housing 10, and the additional mount portion 73, additionally disposed at the upstream end of the dedicated mount portion 71 in the transportation direction D. Here, the dedicated mount portion 71 corresponds to the unchanged mount portion 70*a*, and an additional mount portion 73 corresponds to the extended mount portion 70*b*.

The dedicated mount portion 71 in the long mount portion 70A is formed as a mount portion disposed above a raised portion 78, provided for raising the mount surface 21 when the mount portion 20A in the feed unit 12 on the upper side is in the lowermost position.

Here, the raised portion 78 is used to reduce the quantity (mass) of the long sheet-shaped media 9B stacked on the long mount portion 70A to further reduce the load on the lift 30 than in the case where no raised portion 78 is disposed (for example, a case where the long mount portion 70A is coupled to the additional mount portion 73 while having the mount surface of the additional mount portion 73 located at the same level as the mount portion 20A).

The raised portion 78 is a construction disposed on the mount surface 21 of the mount portion 20A. On the upper portion of the raised portion 78, the dedicated mount portion 71 having the mount surface 72 is disposed. The mount surface 72 receives the downstream side portion (from the leading end to the middle portion) of the long sheet-shaped media 9B in the transportation direction D.

Except for the dedicated mount portion 71, the raised portion 78 is formed as a construction including, for example, a downstream end wall 78A, an upstream end wall 78B, and an intermediate portion 78C. The downstream end wall 78A extends in the apparatus depth direction Z on the downstream side in the transportation direction D. The upstream end wall 78B extends in the apparatus depth direction Z on the upstream side in the transportation direction D. The intermediate portion 78C extends in the transportation direction D between the downstream end wall 78A and the upstream end wall 78B to support the dedicated mount portion 71.

The additional mount portion 73 has an upstream end portion 73*b* protruding outward from the side portion 10S of the housing 10. Thus, the upstream end portion 73*b* extends from the inside (upstream end portion of the dedicated mount portion 71) of the housing 10 into the body 61 of the additional device 6. The additional mount portion 73 has a mount surface 74 that receives the upstream portions (trailing ends) of the long sheet-shaped media 9B in the transportation direction D.

As illustrated in FIGS. 5, 7, and 9 and other drawings, the dedicated mount portion 71 in the long mount portion 70A is disposed while having the left and right side walls 25L and 25R in the feed unit 12 on the upper side protruding upward at the left and right edges in the left and right directions L and R crossing the transportation direction D. Here, the first air outlets 50 in and the height limiters 55 on the left and right side walls 25L and 25R are located above the mount surface 72 of the dedicated mount portion 71 (FIGS. 5 and 7).

As illustrated in FIGS. 6 and 9, to correspond to the left and right side walls 25L and 25R having the above structure movable in the left and right directions L and R, the dedicated mount portion 71 has the mount surface 72 having two types (fixed and sliding) of surface structures, as in the case of the mount surface 21 of the mount portion 20A.

Specifically, the mount surface 72 includes a fixed surface portion 72A, fixed at the middle position in the left and right directions L and R to extend in the transportation direction D, and multiple slide surface portions 72B, disposed to slide in the left and right directions L and R in response to movement of the left and right side walls 25L and 25R on both left and right sides of the fixed surface portion 72A.

As illustrated in FIGS. 4 to 7 and 9 and other drawings, the additional mount portion 73 in the long mount portion 70A includes left and right side walls 63L and 63R and a rear end wall 64. The left and right side walls 63L and 63R come into contact with the left and right edges of the long sheet-shaped media 9B stacked on the mount surface 74 at the trailing end portions to guide the left and right edges in the transportation direction D. The rear end wall 64 aligns the trailing ends of the long sheet-shaped media 9B on the upstream side in the transportation direction D for positioning.

The side walls 63L and 63R each include a contact surface 631 (FIG. 5) that comes into contact with the left or right edges of the long sheet-shaped media 9B. The entireties of the side walls 63L and 63R are movable in the left and right directions L and R over the bottom portion of the body 61 of the additional device 6. Thus, the side walls 63L and 63R are moved to the positions corresponding to the positions of the left and right edges of the long sheet-shaped media 9B for adjustment.

To correspond to the left and right side walls 63L and 63R having a structure movable in the left and right directions L and R, as illustrated in FIGS. 6 and 9, the additional mount portion 73 has the mount surface 74 having two types of (fixed and sliding) surface structures as in the case of the mount surface 72 in the dedicated mount portion 71.

Specifically, as illustrated in FIG. 9 and other drawings, the mount surface 74 includes a fixed surface portion 74A, multiple slide surface portions 74B, and a right fixed surface portion 74C. The fixed surface portion 74A is fixed at the middle portion in the left and right directions L and R to extend in the transportation direction D. The multiple slide surface portions 74B slide in the left and right directions L and R in response to movement of the left side wall 63L on the left side of the fixed surface portion 74A. The right fixed surface portion 74C has slide grooves 74*m* (FIG. 9) in the upper surface. The slide grooves 74*m* allow the right side wall 63R to slide in the left and right directions L and R.

The rear end wall 64 has a contact surface 641 (FIG. 7) that comes into contact with the trailing ends of the long sheet-shaped media 9B. The entirety of the rear end wall 64 is movably held by, for example, a magnetic force on a sliding surface extending in the transportation direction D on the fixed surface portion 74A of the mount surface 74. Thus, the rear end wall 64 is moved to the position corresponding to the position of the trailing ends of the long sheet-shaped media 9B for adjustment.

As illustrated in FIG. 5 or 7, as in the case of the air outlets 50 in the left side wall 25L, second air outlets 65 are formed in the contact surface 631 of the left side wall 63L. The second air outlets 65 blow air to the left edges of the long sheet-shaped media 9B stacked on the additional mount portion 73 at the trailing end portions.

In the first exemplary embodiment, the left side wall 63L has two second air outlets 65A and 65B spaced apart in the transportation direction D. The second air outlet 65A, or the inner second air outlet 65A, is formed in a portion of the contact surface 631 of the left side wall 63L located inward from the side portion 10S of the housing 10. The second air outlet 65B, or the outer second air outlet 65B, is formed in a portion of the contact surface 631 of the left side wall 63L located outward from the side portion 10S of the housing 10.

As illustrated in FIG. 7, the second air outlets 65A and 65B are formed from openings having lower ends 65*u* disposed below lower ends 50*u* of the first air outlets 50A and 50B. In other words, the lower ends 65*u* of the second air outlets 65A and 65B are at the level, from the mount surface (actually, the mount surface 74) of the long mount portion 70A, lower than the level of the lower ends 50*u* of the first air outlets 50A and 50B from the mount surface (actually, the mount surface 72) of the long mount portion 70A.

Here, the second air outlets 65A and 65B are formed from openings having the upper ends located at substantially the same level as the upper ends of the first air outlets 50A and 50B. As illustrated in FIGS. 7 and 12, the lower ends 65*u* of the second air outlets 65A and 65B are located lower by a predetermined dimension $\alpha 1$ than the lower ends 50*u* of the first air outlets 50A and 50B. The dimension $\alpha 1$ may be any value, for example, selected from a range of several centimeters.

As illustrated in FIGS. 7 and 12A and 12B, the second air outlets 65A and 65B are formed from vertically long openings. Each of the second air outlets 65A and 65B according to the first exemplary embodiment is an opening including multiple (for example, four) vertically long openings 652 equidistantly arranged in the transportation direction D inside an outlet frame 651.

As illustrated in FIGS. 12A and 12B, each of the first air outlets 50A and 50B according to the first exemplary embodiment is formed from a movable opening 502, which is a horizontally long rectangular that moves vertically inside an outlet frame 501 formed from a horizontally long rectangular.

The movable openings 502 move up to the uppermost position, as illustrated in FIG. 12B, from a lowermost home position, as illustrated in FIG. 12B, during the operation of transporting the sheet-shaped media 9A and 9B (in a strict sense, at the suction performed by, for example, the suction portion 41 of the discharger 40A). After the suction, the movable openings 502 return to the lowermost home position. The portion of each outlet frame 501 other than the movable opening 502 is closed by a closing portion 503 that moves integrally with the movable opening 502.

The lower ends 50*u* of the first air outlets 50A and 50B each having the movable opening 502 serve as the lower ends of the movable openings 502.

Thus, the lower ends 50*u* of the first air outlets 50A and 50B shift vertically. The dimension $\alpha 1$, corresponding to the height difference between the lower ends 65*u* of the second air outlets 65A and 65B and the lower ends 50*u* of the first air outlets 50A and 50B at this time, also changes until it increases up to a maximum dimension $\alpha 2$ ($>\alpha 1$), as illustrated in FIGS. 12A and 12B.

Also for the first air outlets 50A and 50B including the movable openings 502, the lower ends 65*u* of the second air outlets 65A and 65B may be located at any positions lower than the lower ends 50*u* of the movable openings 502 in the lowermost home position (FIG. 12A).

Figure 13A:
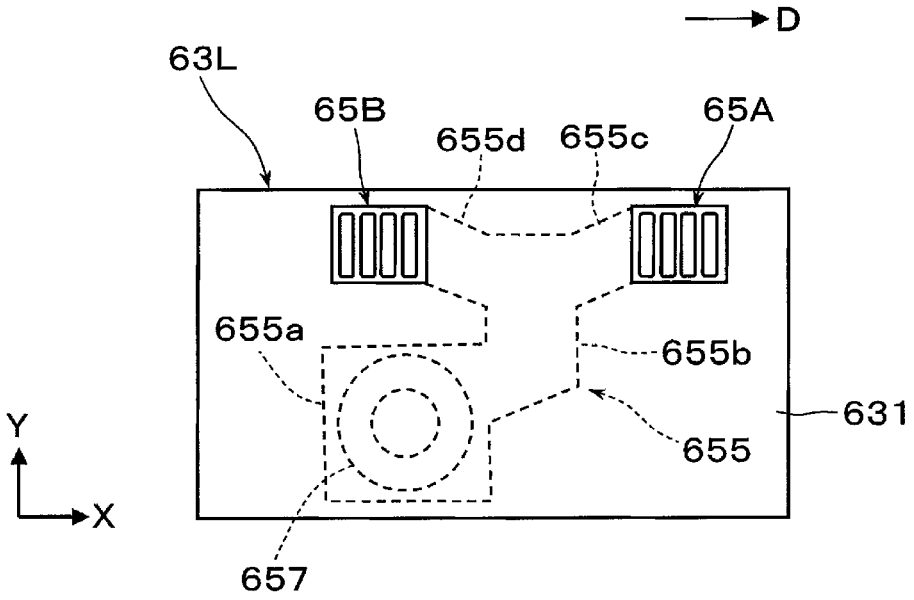
FIG. 13A is a schematic side view of the second air outlets.
Figure 13B:
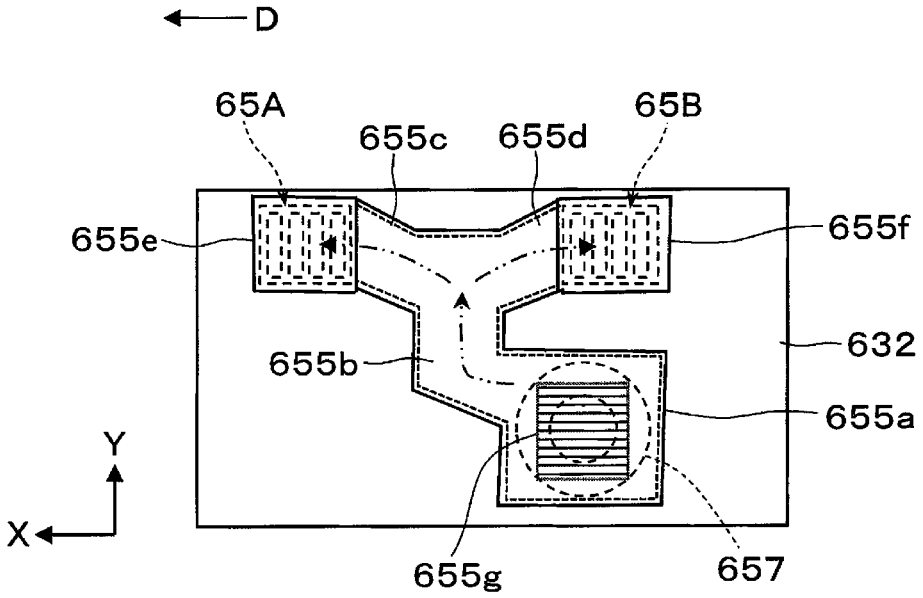
FIG. 13B is a schematic side view of the second air outlets in FIG. 13A, viewed from the opposite side (outer side)

As illustrated in FIGS. 13A and 13B, the inner second air outlet 65A and the outer second air outlet 65B are formed integrally with or connected to trailing ends 655*e* and 655*f* of bifurcate portions 655*c* and 655*d* formed by bifurcating a fan duct 655 disposed at an outer portion 632 (portion opposite to the contact surface 631) of the left side wall 63L. Thus, the second air outlets 65A and 65B are easily formed in the side wall 63L.

FIGS. 13A and 13B illustrate a fan 657, such as a sirocco fan, a body 655*a* of the fan duct 655 that accommodates the fan 657, a draft air duct 655*b* protruding from the body 655*a*, and an air intake port 655*g* formed in the side surface of the body 655*a*. The bifurcate portions 655*c* and 655*d* extend in the lateral direction in the upper portion of the draft air duct 655*b* on the downstream side and the upstream side in the transportation direction D.

Here, when integrally formed on the trailing ends 655*e* and 655*f* of the bifurcate portions 655*c* and 655*d* of the fan duct 655, the second air outlets 65A and 65B are formed at, for example, the trailing ends 655*e* and 655*f*. Here, the fan duct 655 is attached to attachment openings, not illustrated, formed in the side wall 63L while having the trailing ends 655*e* and 655*f* of the fan duct 655 including the second air outlets 65A and 65B fitted into the attachment openings.

When the second air outlets 65A and 65B are connected to the trailing ends 655*e* and 655*f* of the bifurcate portions 655*c* and 655*d* of the fan duct 655, for example, the second air outlets 65A and 65B are attached to the attachment openings, not illustrated, in the left side wall 63L, or the attachment openings themselves are formed to serve as the second air outlets 65A and 65B. Subsequently, the trailing ends 655*e* and 655*f* of the bifurcate portions 655*c* and 655*d* of the fan duct 655 are coupled to the second air outlets 65A and 65B. Thus, the second air outlets 65A and 65B are connected to the trailing ends 655*e* and 655*f* of the fan duct 655.

As illustrated in FIGS. 7 and 9, as in the case of the height limiters 55 on the left side wall 25L in the feed unit 12 on the upper side, the left side wall 63L has a contact surface 631 on which multiple height limiters 67 are disposed. The multiple height limiters 67 come into contact with the upper surface portions of the left and right edges of the long sheet-shaped media 9B stacked on the additional mount portion 73 at the trailing end portions to limit the upper surface portions to a predetermined height.

In the first exemplary embodiment, the left side wall 63L has two height limiters 67 spaced apart on both sides, that is, downstream and upstream from the inner second air outlet 65A in the transportation direction D.

The height limiters 67 are formed from, for example, plate members protruding by a predetermined length from a predetermined height of the contact surface 631 of the left side wall 63L over and above the mount surface 74 of the additional mount portion 73. During an operation of stacking the long sheet-shaped media 9B on the mount surface 74 of the additional mount portion 73, the height limiters 67 are, for example, retracted in the side wall 63L without protruding from the contact surface 631.

The height limiters 67 hold from above the left and right edges of the long sheet-shaped media 9B floated by air blown from the second air outlets 65A and 65B at the additional mount portion 73, to keep the long sheet-shaped media 9B at a predetermined height over the mount surface 74 of the additional mount portion 73.

The right side wall 63R is formed from a plate member extending in the transportation direction D. The right side wall 63R has a contact surface 631 on which neither the second air outlets 65 nor the height limiters 67 are disposed (FIG. 9). The contact surface 631 comes into contact with the downstream right edges of the long sheet-shaped media 9B.

As illustrated in FIGS. 7 to 9 and other drawings, in the sheet-shaped-medium feeder 1, the lift 30 has the wires 31 attached to the dedicated mount portion 71 of the long mount portion 70A, corresponding to the unchanged mount portion 70*a*, and to the additional mount portion 73, corresponding to the extended mount portion 70*b*.

The lift 30 according to the first exemplary embodiment has the wires 31 attached to, for example, the dedicated mount portion 71 at the above-described four positions, and attached at two positions, that is, one position in the transportation direction D at each of left and right edges of the additional mount portion 73 in the direction crossing the transportation direction D.

As illustrated in FIGS. 8, 9, and 11B and other drawings, in addition to the four positions at which the wires 31 of the lift 30 are attached, the additional mount portion 73 has two hanging portions 68*a* and 68*b* at left and right edges. The hanging portions 68*a* and 68*b* protrude outward.

As illustrated in FIG. 8, the additional mount portion 73 has the hanging portions 68*a* and 68*b* fitted into two guide portions 69 from the inner side of the body 61. The guide portions 69 are disposed on the near and far side walls of the body 61 of the additional device 6. The guide portions 69 are guide grooves or long guide holes linearly extending by a predetermined length in the vertical direction, as in the case of the guide holes 174 formed in, for example, the feed unit 12 on the upper side of the housing 10.

Thus, the additional mount portion 73 vertically moves while having the hanging portions 68*a* and 68*b* guided along the guide portions 69 inside the body 61 of the additional device 6.

As illustrated in FIGS. 7 to 9 and other drawings, the lift 30 includes two wires 31*e* and 31*f* and winding pulleys 32*e* and 32*f*. The two wires 31*e* and 31*f* have their trailing ends respectively coupled to the hanging portions 68*a* and 68*b* at two positions of the additional mount portion 73. The winding pulleys 32*e* and 32*f* are rotatably attached to portions of the body 61 above the upper ends of the guide portions 69, and allow the wires 31*e* and 31*f* to be wound therearound.

The hanging portions 68*a* and 68*b* and the winding pulleys 32*e* and 32*f* are disposed in the additional device 6 in advance.

As illustrated in FIGS. 7 and 9 and other drawings, the wire 31*e* disposed on the left is taken up by the left taking-up pulley 34L after being wound around the winding pulley 32*e*, the winding pulley 32*b*, the auxiliary pulley 33*b*, the auxiliary pulley 33*a*, and the winding pulley 32*a* in this order. As illustrated in FIGS. 8 and 9 and other drawings, the wire 31*f* disposed on the right is taken up by the right taking-up pulley 34R after being wound around the winding pulley 32*f*, the winding pulley 32*d*, and the winding pulley 32*c* in this order.

The wires 31*e* and 31*f* are prepared as attachments of the additional device 6.

To feed the long sheet-shaped media 9B, the additional device 6 is retrofitted to the side portion 10S of the housing 10. Here, the additional device 6 is an option, and thus may be attached at factory shipment in response to receipt of an order before factory shipment.

In attachment of the additional device 6, the long mount portion 70A and other components are also attached.

Here, the dedicated mount portion 71 in the long mount portion 70A is fixed onto the mount surface 21 of the mount portion 20A in the container 17A of the feed unit 12 on the upper side of the housing 10 via the raised portion 78. The long mount portion 70A is assembled while having the upstream end portion of the dedicated mount portion 71 in the transportation direction D being coupled to the additional mount portion 73 with a fastening device not illustrated to be integrated.

To attach the additional device 6 including the lift 30, additional portions of the lift 30 are assembled in the following manner.

Specifically, to assemble the additional portions of the lift 30, the wires 31*e* and 31*f* are attached to the hanging portions 68*a* and 68*b* of the additional mount portion 73, and wound around, for example, the winding pulleys 32*e* and 32*f* and the taking-up pulleys 34L and 34R.

Feeder to which Additional Device is Attached

Figure 14A:
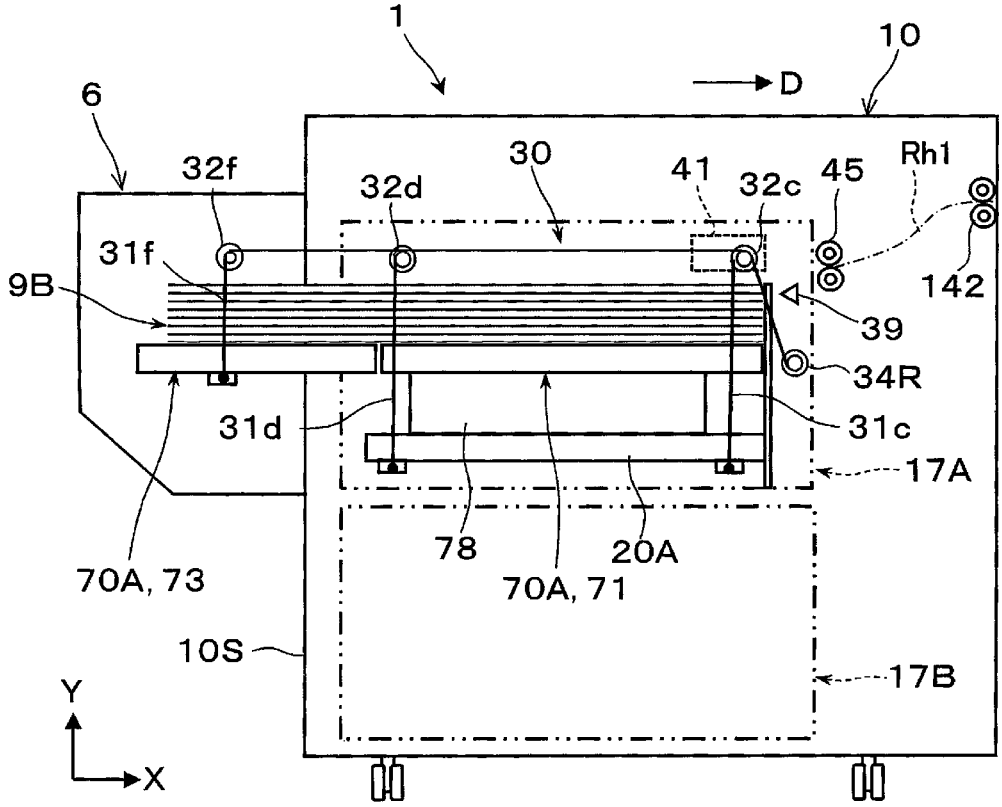
FIG. 14A is a schematic side view illustrating the operation of the feeder illustrated in FIG. 3.
Figure 14B:
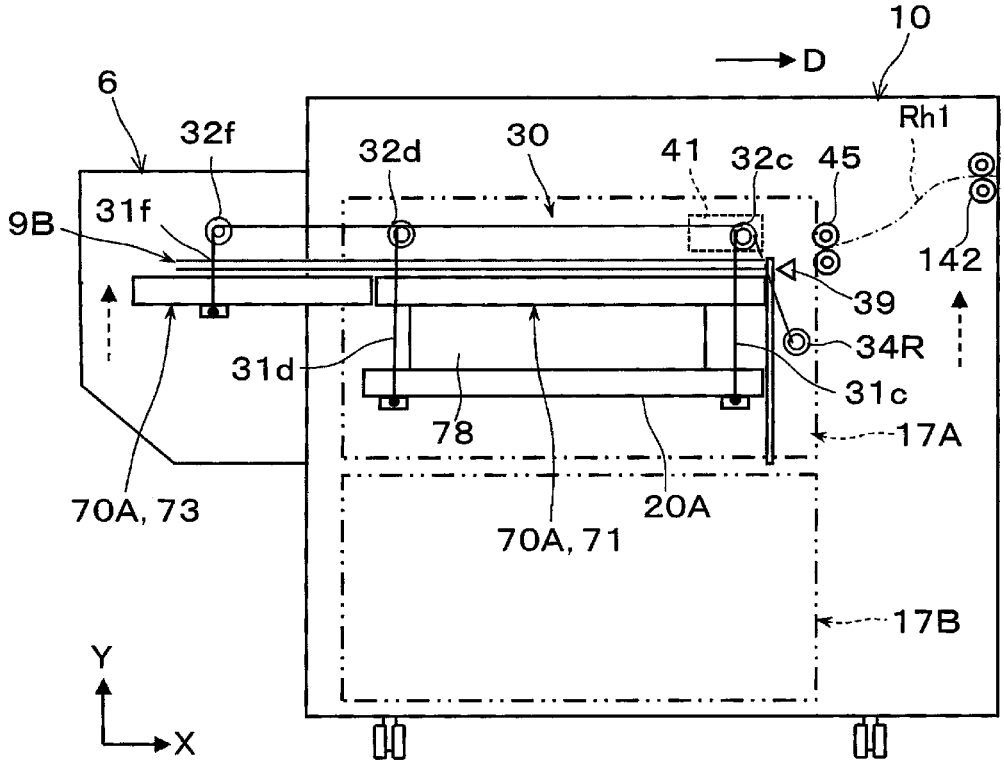
FIG. 14B is a schematic side view illustrating an operation different from the operation of the feeder illustrated in FIG. 14A.

As illustrated in FIGS. 14A and 14B, the sheet-shaped-medium feeder 1 to which the additional device 6 is attached is capable of receiving the long sheet-shaped media 9B on the long mount portion 70A including the dedicated mount portion 71 and the additional mount portion 73.

In the first exemplary embodiment, the long mount portion 70A is formed as, for example, a mount portion capable of receiving the long sheet-shaped media 9B with a length in the transportation direction D (length when discharged) of longer than 488 mm and equal to or shorter than 864 mm.

Here, in the sheet-shaped-medium feeder 1, to stack the long sheet-shaped media 9B on the long mount portion 70A, as illustrated in FIG. 4, the open-close member 15 in the upper portion 11 of the housing 10 and the open-close portion 62 in the additional device 6 are opened before the stacking operation.

To perform the operation of stacking the long sheet-shaped media 9B, the rotation shaft 35 and the driving device 37 in the lift 30 are temporarily disconnected, and the long mount portion 70A is lowered by its weight to the lowest position of the mount portion 20A that supports the raised portion 78 of the dedicated mount portion 71.

After the operation of stacking the long sheet-shaped media 9B is finished, the open-close member 15 and the open-close portion 62 are closed (FIG. 3). Here, the rotation shaft 35 and the driving device 37 in the lift 30 are coupled together.

Operation of Feeding Long Sheet-Shaped Medium

The feeder 1 to which the additional device 6 is retrofitted feeds the long sheet-shaped media 9B in the following manner.

As illustrated in FIG. 14A, in the feeder 1, the long mount portion 70A receives the long sheet-shaped media 9B, and the long mount portion 70A is raised when performing the feeding operation.

The long mount portion 70A at this time is hung in the container 17A of the housing 10 and the body 61 of the additional device 6 by the lift 30 simultaneously taking up the wires 31*a*, 31*b*, 31*c*, 31*d*, 31*e*, and 31*f*. The long mount portion 70A is raised until the top portion of the long sheet-shaped media 9B stacked on the long mount portion 70A reaches the predetermined height (until detection information is acquired from the position sensor 39).

As illustrated in FIG. 14B, the long mount portion 70A is appropriately raised by an appropriate amount regardless of reduction, resulting from the feeding, of the quantity of the long sheet-shaped media 9B stacked on the long mount portion 70A.

Here, in the feeder 1, the long mount portion 70A is raised by the additional mount portion 73 being hung by the lift 30 taking up the wires 31*e* and 31*f*, in addition to the dedicated mount portion 71 being hung by the lift 30 taking up the wires 31*a*, 31*b*, 31*c*, and 31*d*. In other words, the long mount portion 70A is raised in response to the operation of the dedicated mount portion 71 and the additional mount portion 73 being hung with the wires 31 of the lift 30.

Thus, in the feeder 1, the long mount portion 70A is preferably raised or lowered, particularly, raised while being well balanced as a whole, unlike in the case where the lift 30 has no wire 31 attached to both the dedicated mount portion 71, corresponding to the mount portion 20A of the unchanged mount portion 70A, and the additional mount portion 73, corresponding to the extended portion.

Figure 15:
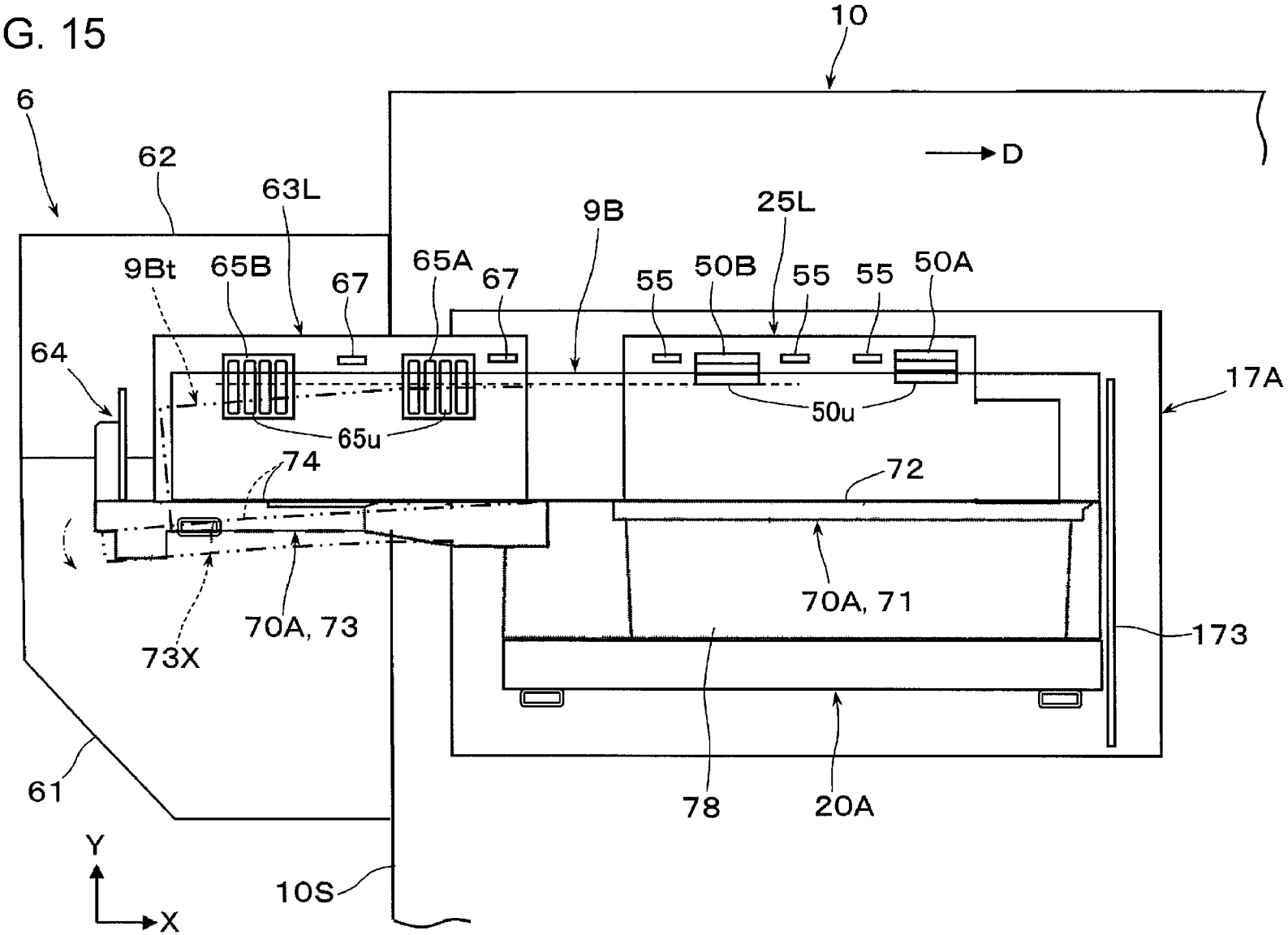
FIG. 15 is a schematic side view illustrating part of the operation of the feeder illustrated in FIGS. 14A and 14B.

Subsequently, as illustrated in FIGS. 9 and 15, in the long mount portion 70A, air is discharged from the first air outlets 50A, 50B, 50C, and 50D in the left and right side walls 25L and 25R in the housing 10 and the second air outlets 65A and 65B in the left side wall 63L in the additional device 6 to cause upper ones of the long sheet-shaped media 9B stacked on the long mount portion 70A to float and separate from each other with the air flow.

Here, the upper ones of the long sheet-shaped media 9B floated in the long mount portion 70A have their left and right edges held from above by being in contact with the multiple height limiters 55 on the left and right side walls 25L and 25R and the multiple height limiters 67 on the left side wall 63L in the additional device 6, to have their height limited.

Here, in the container 17A in the housing 10, the leading end portion, in the transportation direction D, of the floated uppermost one of the sheet-shaped media 9B is sucked by receiving a suction force from the suction portion 41 of the discharger 40A.

Subsequently, in the feeder 1 to which the additional device 6 is attached, the suction portion 41 of the discharger 40A moves to transport the leading end of the sucked one of the long sheet-shaped media 9B on the downstream side in the transportation direction D to the delivery position where the suction portion 41 passes the leading end to the transport portion 45 of the discharger 40A, to pass the leading end to the transport portion 45. In addition, the transport portion 45 discharges the delivered long sheet-shaped medium 9B from the long mount portion 70A and the container 17A with a transport force to feed the long sheet-shaped medium 9B to the first transport path Rh1.

Thus, after the long sheet-shaped medium 9B is discharged from the discharge port 18 via the first transport path Rh1, the long sheet-shaped medium 9B is fed from the feeder 1 to which the additional device 6 is attached to the image forming apparatus 120A (the first introduction transport path Rt1 of the image forming apparatus 120A), serving as an example of a destination.

In addition to the first air outlets 50 in the left and right side walls 25L and 25R of the dedicated mount portion 71 in the long mount portion 70A, the feeder 1 has the second air outlets 65 in the left side wall 63R of the additional mount portion 73 in the long mount portion 70A.

Thus, in the feeder 1, unlike in the structure where no second air outlets 65 are formed in the left side wall 63R of the additional mount portion 73, the long sheet-shaped media 9B stacked on the long mount portion 70A are separated with flow of air blown out from the second air outlets 65 to the upstream end portion in the transportation direction D. Thus, upper ones of the stacked long sheet-shaped media 9B are separated from each other.

Here, the additional mount portion 73 has no second air outlets 65 in the right side wall 63R. However, the right side wall 63R is formed from a plate member having the contact surface 631. The contact surface 631 blocks the air blown from the second air outlets 65 in the left side wall 63R without allowing the air to directly blow out from the right edges of the long sheet-shaped media 9B at the upstream side in the transportation direction D. Thus, the air is effectively used to separate the long sheet-shaped media 9B.

In the image forming system 100A including the feeder 1, also when the long sheet-shaped media 9B are stacked on the long mount portion 70A of the feeder 1, the stacked long sheet-shaped media 9B are separated up to the upstream end portions in the transportation direction D. Thus, the long sheet-shaped media 9B are fed to the image forming apparatus 120A, serving as an example of the processing device 120, without causing jamming or overlapping transport. Thus, the image forming system 100A preferably forms images on the normally fed long sheet-shaped media 9B.

In the feeder 1, the second air outlets 65 include the inner second air outlet 65A, disposed inside the housing 10, and the outer second air outlet 65B, disposed out of the side portion 10S of the housing 10.

Thus, unlike in the structure not including the inner second air outlet 65A and the outer second air outlet 65B, the feeder 1 allows air to reliably flow to the upstream end portions of the long sheet-shaped media 9B stacked on the long mount portion 70A in the transportation direction D to separate the long sheet-shaped media 9B from each other.

In the feeder 1, the second air outlets 65 are formed from openings having lower ends 65*u* located below the lower ends 50*u* of the first air outlets 50.

Thus, for example, even when the additional mount portion 73 in the long mount portion 70A, serving as an example of the extended mount portion 70*b*, bends down, as illustrated with chain double-dashed lines in FIG. 15, due to the weight of the long sheet-shaped media 9B stacked thereon, the feeder 1 allows the long sheet-shaped media 9B to be efficiently separated from each other up to the upstream end portions in the transportation direction D.

Specifically, the feeder 1 is capable of reliably blowing air from the second air outlets 65 to the left edges of the long sheet-shaped media 9B stacked on the downwardly bent additional mount portion 73 on the upstream side in the transportation direction D. Thus, the feeder 1 allows air to flow to the upstream end portions of the long sheet-shaped media 9B in the transportation direction D to separate the long sheet-shaped media 9B from each other, unlike in the case where the second air outlets 65 are not formed from openings having the lower ends 65*u* located below the lower ends 50*u* of the first air outlets 50.

Moreover, in the feeder 1, the second air outlets 65 are formed from the vertically long openings 652 (FIGS. 12A and 12B).

Thus, even when the additional mount portion 73 in the long mount portion 70A bends downward as described above, the feeder 1 allows air to flow to the upstream end portions of the long sheet-shaped media 9B stacked on the bent additional mount portion 73 on the upstream side in the transportation direction D to separate the long sheet-shaped media 9B from each other, unlike in the case where the second air outlets 65 are not formed from the vertically long openings 652.

In contrast, for example, in a structure where the lower ends 65*u* of the second air outlets 65 are at the same level (position indicated with a broken line in FIG. 15) as the lower ends 50*u* of the first air outlets 50, the structure has the following defect when the additional mount portion 73 bends downward due to the weight of the long sheet-shaped media 9B stacked thereon, as exemplarily illustrated in FIG. 15 with chain double-dashed lines.

Specifically, the structure may fail to blow air from the second air outlets 65 to the left edges of an upper portion 9Bt of the long sheet-shaped media 9B stacked on the mount surface 74 of the additional mount portion 73 bent downward.

In this case, when the downstream ends of the upper portion 9Bt of the long sheet-shaped media 9B in the transportation direction D keep in close contact with each other, for example, the long sheet-shaped media 9B may be jammed during transportation, or multiple long sheet-shaped media 9B may be transported while overlapping with each other. The additional mount portion 73 is more likely to bend downward in a structure where the lift 30 has no wires 31 attached to the additional mount portion 73.

Second Exemplary Embodiment

Figure 16:
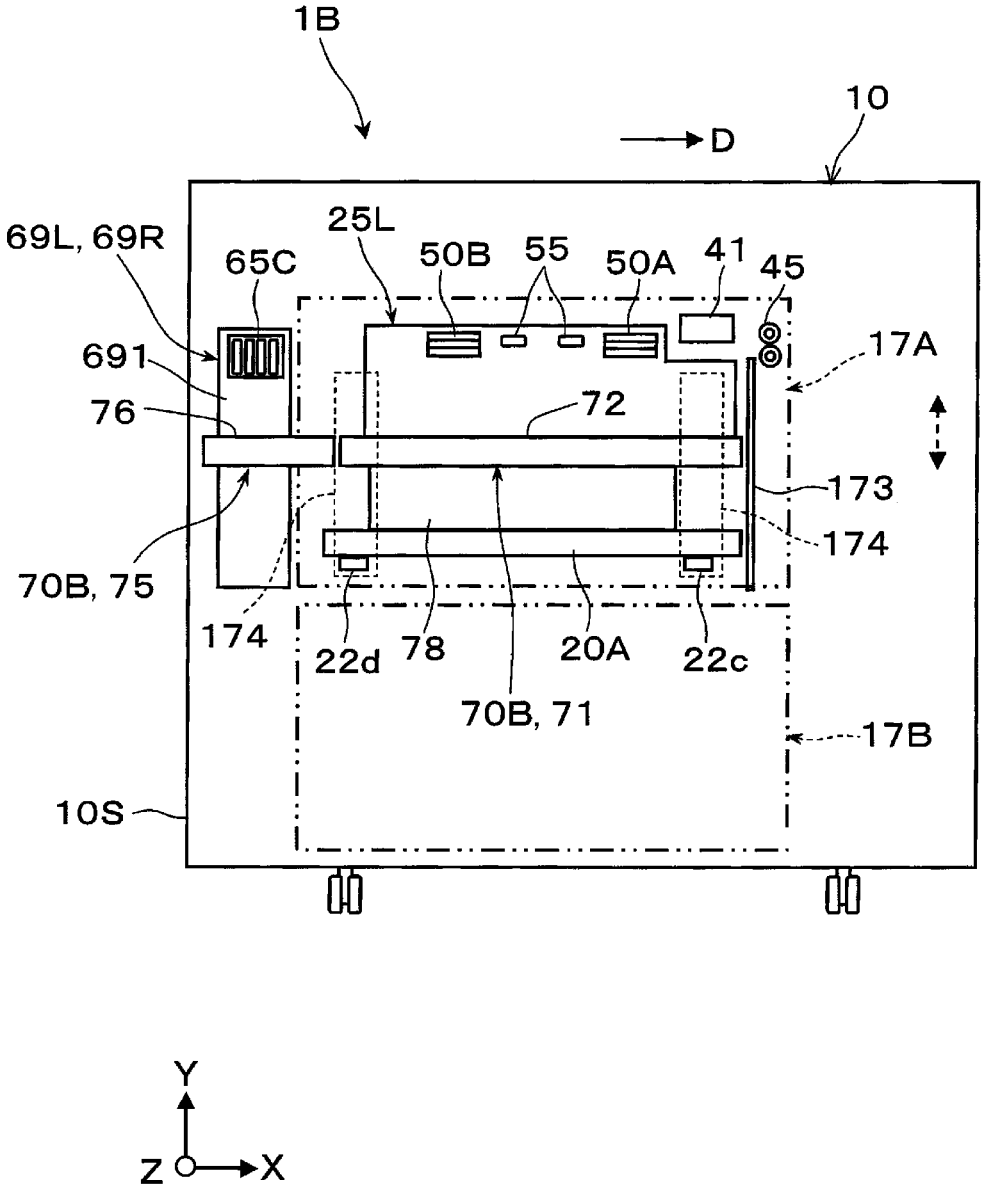
FIG. 16 is a schematic side view of a feeder according to a second exemplary embodiment.

FIG. 16 illustrates a sheet-shaped-medium feeder 1B according to a second exemplary embodiment.

The sheet-shaped-medium feeder 1B is substantially similar to the feeder 1 according to the first exemplary embodiment except that it includes a long mount portion 70B used as the long mount portion 70 without the additional device 6 being attached thereto. The long mount portion 70B is accommodated in the housing 10, including the extended mount portion 70*b*.

Figure 17A:
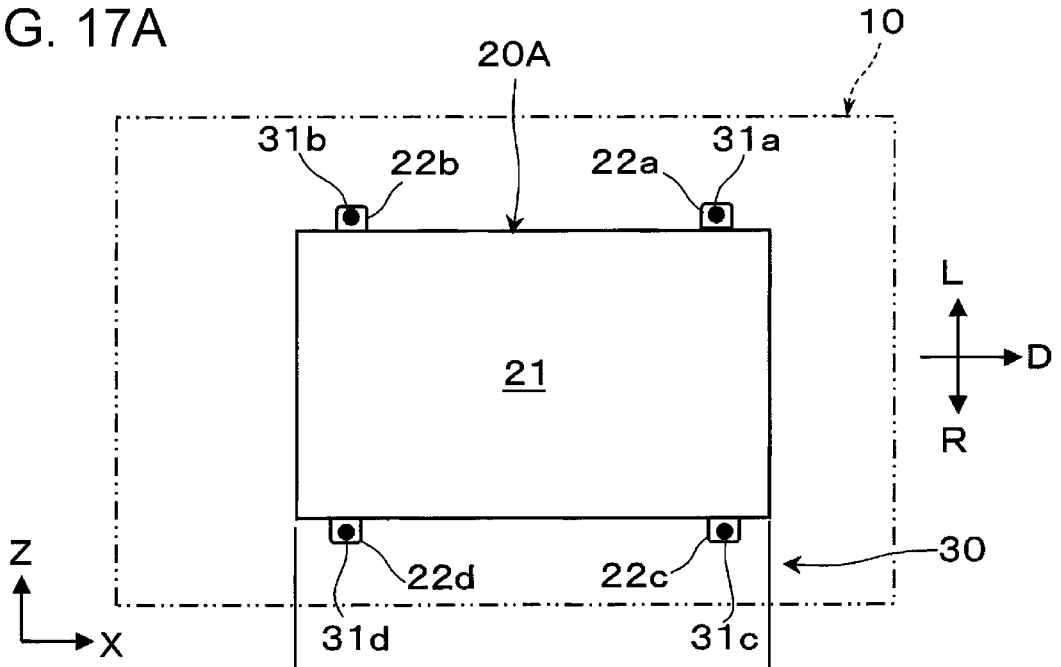
FIG. 17A is a schematic plan view of an unchanged mount portion in the feeder illustrated in FIG. 16.

As illustrated in FIGS. 16 and 17, the long mount portion 70B in the feeder 1B includes the dedicated mount portion 71 disposed in the housing 10, and the additional mount portion 75, additionally disposed at the upstream end portion of the dedicated mount portion 71 in the transportation direction D to extend the upstream end portion. Here, the dedicated mount portion 71 corresponds to the unchanged mount portion 70*a*, and an additional mount portion 75 corresponds to the extended mount portion 70*b*.

The dedicated mount portion 71 has the same structure as the dedicated mount portion 71 according to the first exemplary embodiment. Specifically, the dedicated mount portion 71 is disposed above the raised portion 78 placed on the mount portion 20A in the container 17A in the feed unit 12 on the upper side.

The dedicated mount portion 71 includes a mount surface 72 having the same structure as that of the dedicated mount portion 71 according to the first exemplary embodiment.

The additional mount portion 75 is disposed in a gap space left between the upstream end of the dedicated mount portion 71 and the side portion 10S of the housing 10, and includes a mount surface 76 that receives the upstream end portions of the long sheet-shaped media 9B in the transportation direction D. The additional mount portion 75 is coupled to and integrated with the upstream end portion of the dedicated mount portion 71 with a fastening device not illustrated.

The additional mount portion 75 includes hanging portions 68*c* and 68*d* respectively disposed at the left and right edges.

Figure 17B:
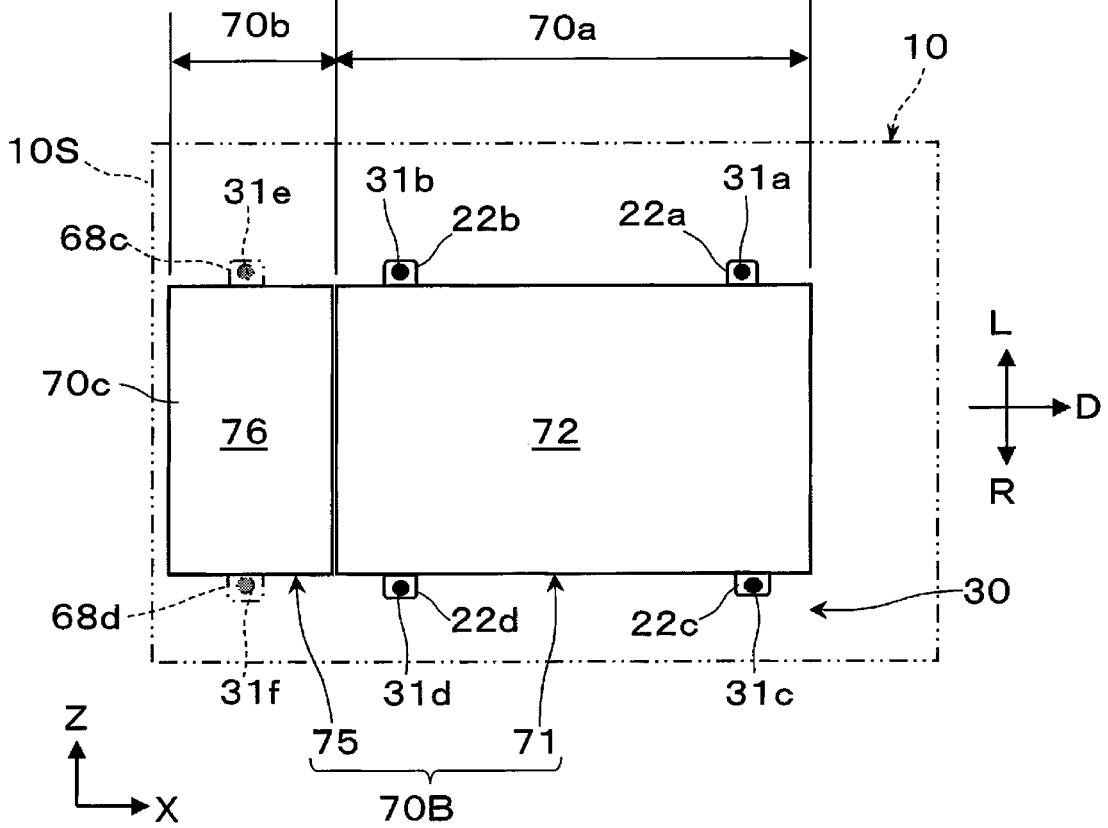
FIG. 17B is a schematic plan view of a long mount portion in the feeder illustrated in FIG. 16 obtained after change.

As illustrated in FIG. 17B, as in the case of the lift 30 according to the first exemplary embodiment, the feeder 1B includes, in the lift 30, the hanging portions 22*a*, 22*b*, 22*c*, and 22*d* at four positions on the dedicated mount portion 71 in the long mount portion 70B, and the wires 31*a*, 31*b*, 31*c*, and 31*d* are respectively attached to the hanging portions 22*a*, 22*b*, 22*c*, and 22*d*.

In the second exemplary embodiment, the wires 31 of the lift 30 are not attached to the additional mount portion 75.

However, also in the second exemplary embodiment, in order, for example, to raise or lower the long mount portion 70B while being well balanced as a whole, the wires 31 of the lift 30 may be attached to the additional mount portion 75. Here, as exemplarity illustrated in FIG. 17B with chain double-dashed lines, the wires 31*e* and 31*f* may be respectively attached to the hanging portions 68*c* and 68*d* at two positions, that is, the left and right edges of the additional mount portion 75. Here, the additional mount portion 75 may omit the guide portions 69 according to the first exemplary embodiment that guide vertical movement of the hanging portions 68*c* and 68*d*.

As illustrated in FIG. 16, the feeder 1B includes left and right side walls 69L and 69R on the additional mount portion 75. The left and right side walls 69L and 69R may have substantially the same structure as the left and right side walls 63L and 63R according to the first exemplary embodiment.

Here, as illustrated in FIG. 16, the left side wall 69L has a contact surface 691 having a second air outlet 65C that blows air to the left edges of the long sheet-shaped media 9B stacked on the additional mount portion 75 on the trailing end side. Similarly to the side wall 63R according to the first exemplary embodiment, the right side wall 69R is formed from a plate member with no second air outlet 65C.

The second air outlet 65C serves as an air outlet inside the housing 10. The second air outlet 65C has substantially the same structure as the second air outlets 65A and 65B according to the first exemplary embodiment.

The feeder 1B having the long mount portion 70B capable of receiving the long sheet-shaped media 9B also allows air to flow to the upstream end portions of the long sheet-shaped media 9B stacked on the long mount portion 70B in the transportation direction D to separate the long sheet-shaped media 9B from each other, unlike in the case where the additional mount portion 75 of the long mount portion 70B has no second air outlet 65C.

Modification Example

Figure 18A:
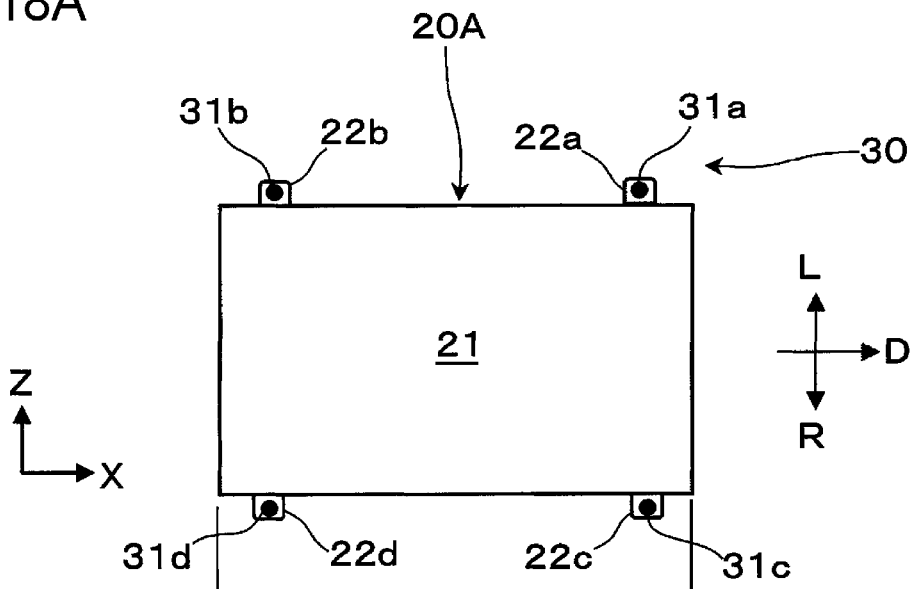
FIG. 18A is a schematic plan view of a long mount portion in a feeder according to a modification example, and FIG.
Figure 18B:
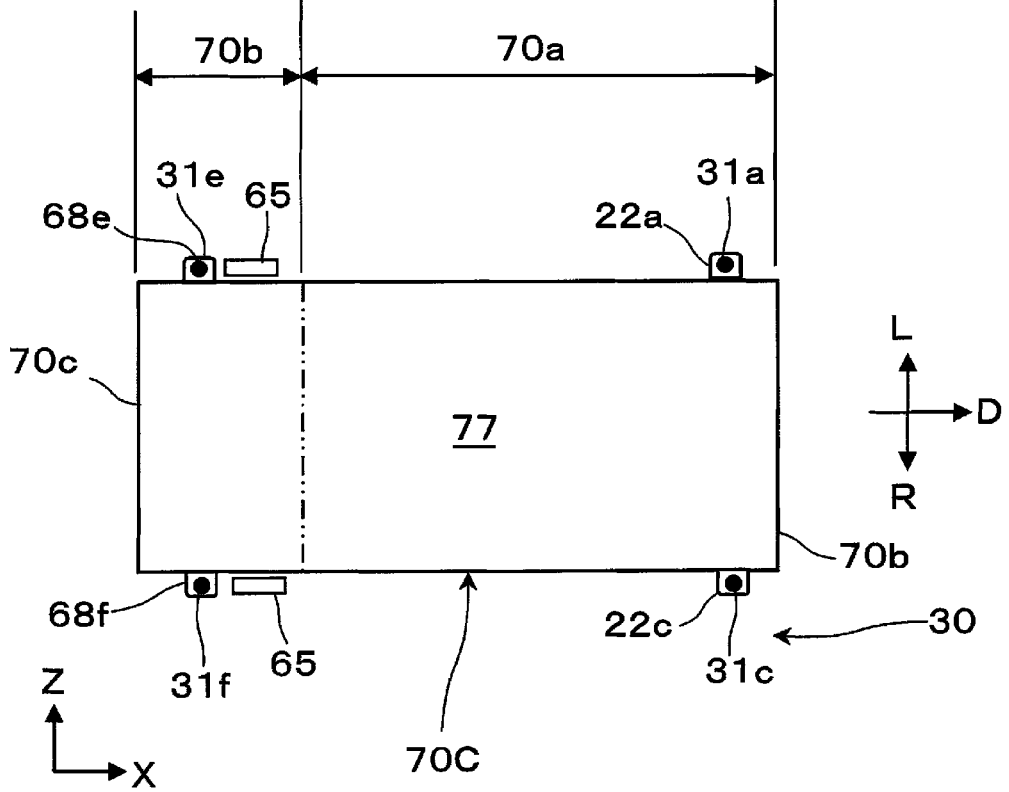

Each of the feeders 1 and 1B according to the first and second exemplary embodiments may include, instead of the long mount portion 70A or 70B, a replacement mount portion 70C exemplarily illustrated in FIGS. 18A and 18B.

The replacement mount portion 70C serves as a long mount portion attached in place of the dedicated mount portion (mount portion 20A) disposed in the housing 10. As illustrated in FIG. 18B, the replacement mount portion 70C also includes the mount portion 20A, which is an unchanged mount portion 70*a*, and the mount portion 70*b* extended from the unchanged portion. A mount portion, corresponding to the mount portion 20A, of the replacement mount portion 70C includes the raised portion 78, but may not include the raised portion 78.

The replacement mount portion 70C includes a continuous mount surface 77. In the strictest sense, the mount surface 77 has a surface structure including the slide surfaces 72B and 74B to install the left and right side walls 25L, 25R, 63L, and 63R.

In the structure including the replacement mount portion 70C, the lift 30 has the wires 31*a* and 31*c* attached to the hanging portions 22*a* and 22*c* disposed at two positions of the mount portion 70*a* corresponding to the unchanged mount portion 20A, and the wires 31*e* and 31*f* attached to hanging portions 68*e* and 68*f* disposed at two positions of the mount portion 70*b* extended from the unchanged portion. The lift 30 may have the wires 31 attached at the four positions on the unchanged mount portion 70*a* of the replacement mount portion 70C, and at the two positions on the mount portion 70*b* extended from before changed.

The feeder 1 including the replacement mount portion 70C also has the second air outlets 65 that blow air to at least one of the left and right edges of the long sheet-shaped media 9B stacked on the extended mount portion 70*b* in the replacement mount portion 70C.

The feeder 1 including the replacement mount portion 70C allows air to flow to the upstream end portions, in the transportation direction D, of the long sheet-shaped media 9B stacked on the extended mount portion 70*b* of the replacement mount portion 70C to separate the long sheet-shaped media 9B from each other, unlike in the case where the second air outlets 65 are not formed in the extended mount portion 70*b* in the replacement mount portion 70C.

The first and second exemplary embodiments have described a structure example of the long mount portion 70 including, as the unchanged mount portion 70*a*, the dedicated mount portion 71 disposed on the mount portion 20A receiving the normal sheet-shaped media 9A with the raised portion 78 interposed therebetween. However, for example, the mount portion 20A may be used without being changed, as the dedicated mount portion 71 without including the raised portion 78 for the unchanged mount portion 70*a*.

For example, the above structure is effective for a feeder capable of receiving a small amount of the long sheet-shaped media 9B, as the weight and load from the long sheet-shaped media 9B does not increase much.

The first and second exemplary embodiments may include side walls including the second air outlets 65 as the right side walls 63R and 69R.

The lift 30 may include line members such as belts instead of the wires 31. When no container 17 is included, the lift 30 may be disposed at any appropriate portion of the housing 10.

The first or another exemplary embodiment has described, as an example of the sheet-shaped-medium handling apparatus 100, the image forming system 100A including the image forming apparatus 120A serving as the processing device 120, but this is not the only possible structure. The handling apparatus 100 may be any apparatus that includes the processing device 120 that performs predetermined processing on the normal sheet-shaped media 9A or the long sheet-shaped media 9B fed from the feeder 1.

Examples of the handling apparatus 100 include a printing system including the processing device 120 used as a printer that attaches ink to the normal sheet-shaped media 9A and other media, a painting system including the processing device 120 used as a painting device that applies a liquid paint to the normal sheet-shaped media 9A and other media, and a drying system including the processing device 120 used as a dryer that dries the normal sheet-shaped media 9A and other media.

To install a sheet-shaped-medium feeder inside the processing device 120, the feeder may be the feeder 1, in which the long mount portion 70 is disposed.

Figure 19:
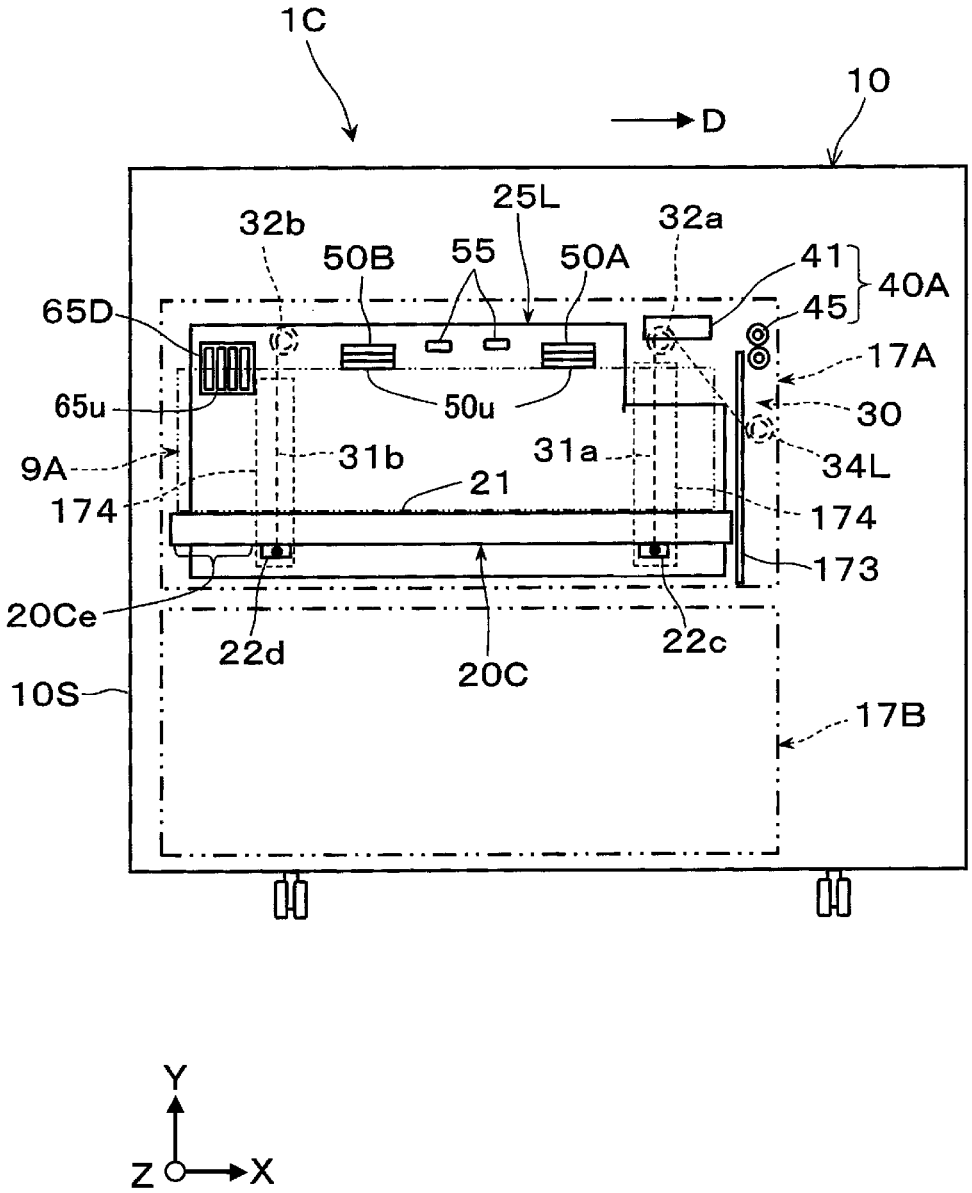
FIG. 19 is a schematic side view of a sheet-shaped-medium feeder according to another modification example.

As illustrated in FIG. 19, the second air outlet 65 may be provided as an upstream air outlet 65D in a sheet-shaped-medium feeder 1C including a mount portion 20C receiving the normal sheet-shaped media 9A and installed in the housing 10 without being changed to the long mount portion 70A, 70B, or 70C. The upstream air outlet 65D blows air to at least one of the left and right edges of the normal sheet-shaped media 9A stacked on a portion near the upstream end of the mount portion 20C in the transportation direction D.

In the feeder 1C here, the lift 30 has four wires 31*a*, 31*b*, 31*c*, and 31*d* at four positions, including two positions in the transportation direction D at each of the left and right edges of the mount portion 20C in the direction crossing the transportation direction D (see FIG. 9). The feeder 1C has downstream air outlets 50A and 50B located downstream from the upstream air outlets 65D in the transportation direction D. The downstream air outlets 50A and 50B blow air to the left and right edges of the normal sheet-shaped media 9A stacked on the downstream portion of the mount portion 20C in the transportation direction D.

As illustrated in FIG. 19, the upstream air outlets 65D are located upstream, in the transportation direction D, from the two wires 31*b* and 31*d* among the four wires 31 attached to the upstream portion of the mount portion 20C in the transportation direction D. The upstream air outlets 65D may be formed from, for example, openings with the lower ends 65*u* located below the lower ends 50*u* of the downstream air outlets 50A and 50B. As in the case of the downstream air outlets 50A and 50B, the upstream air outlets 65D are formed in the contact surfaces 251 of the left and right side walls 25L and 25R.

Even when a portion 20Ce near the downstream end of the mount portion 20C in the transportation direction D bends downward due to the weight of the normal sheet-shaped media 9A stacked thereon, the feeder 1C allows the normal sheet-shaped media 9A stacked on the portion 20Ce near the end of the downwardly bent mount portion 20C to separate from each other up to the upstream end portions in the transportation direction D.

Specifically, the feeder 1C is capable of reliably blowing air from the downstream air outlets 65D to the left and right edges of the normal sheet-shaped media 9A stacked on the portion 20Ce near the end of the downwardly bent mount portion 20C on the upstream side in the transportation direction D. Thus, the feeder 1C allows air to flow up to the upstream end portions of the normal sheet-shaped media 9A in the transportation direction D to separate the normal sheet-shaped media 9A from each other, unlike in a structure not including the downstream air outlets 65D, and where the downstream air outlets 65D are not formed from openings with the lower ends 65*u* located below the lower ends 50*u* of the upstream air outlets 50A and 50B.

The feeder 1C may be an exemplary feeder according to an aspect of the disclosure specified as below.

The feeder is a sheet-shaped-medium feeder 1C that includes a housing 10, a mount portion 20C disposed to be vertically movable in the housing 10 and on which the sheet-shaped media 9A are stacked, a lift 30 including multiple line members to vertically raise or lower the mount portion 20C by hanging the mount portion 20C with the line members, a discharger 40 that transports the sheet-shaped media 9A stacked on the mount portion 20C in order from an upper one of the sheet-shaped media, and air outlets 55 that blow air to the sheet-shaped media 9A stacked on the mount portion 20C at left and right edges in a feed width of the sheet-shaped media, wherein the lift 30 has four line members 31 respectively attached at four positions including two positions in the transportation direction at each of left and right edges of the mount portion 20C in a direction crossing the transportation direction D, wherein the air outlets 55 include upstream air outlets 65D disposed upstream in the transportation direction D from two line members 31*b* and 31*d* among the four line members 31 attached to upstream portions of the mount portion 20C in the transportation direction D, and downstream air outlets 50A and 50B disposed downstream from the upstream air outlets 65D in the transportation direction D, and wherein the upstream air outlets 65D are formed from openings having lower ends 65*u* located lower than lower ends 50*u* of the downstream air outlets 50A and 50B.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet-shaped-medium feeder, comprising:

a housing;

a mount portion that is disposed to be vertically movable in the housing and that receives sheet-shaped media;

a lift that vertically raises or lowers the mount portion and comprises a plurality of pulleys and a plurality of wires coupled to the mount portion and routed between the pulleys;

a discharger that transports the sheet-shaped media stacked on the mount portion in order from an upper one of the sheet-shaped media, and comprises a suction portion disposed to oppose a mount surface of the mount portion and a transport portion disposed downstream from the suction portion in a transportation direction of the sheet-shaped media; and first air outlets that blow air to the sheet-shaped media stacked on the mount portion at left and right edges in a feed width of the sheet-shaped media, wherein the mount portion is changeable to a long mount portion capable of receiving long sheet-shaped media by extending, further upstream in a transportation direction of the sheet-shaped media, an upstream end portion of the mount portion in the transportation direction of the sheet-shaped media, wherein the sheet-shaped-medium feeder has a second air outlet that blows air to at least one of left and right edges of the long sheet-shaped media stacked on an extended portion of the long mount portion, and wherein at least an upstream end portion, in the transportation direction, of the extended portion of the long mount portion protrudes outward from a side portion of the housing.

2. The sheet-shaped-medium feeder according to claim 1, wherein the long mount portion including the extended portion is accommodated in the housing.

3. The sheet-shaped-medium feeder according to claim 2, wherein the second air outlet is disposed inside the housing.

4. The sheet-shaped-medium feeder according to claim 3, wherein the second air outlet is an opening having a lower end located below lower ends of the first air outlets.

5. The sheet-shaped-medium feeder according to claim 2, wherein the second air outlet is an opening having a lower end located below lower ends of the first air outlets.

6. The sheet-shaped-medium feeder according to claim 1, wherein the second air outlet is disposed inside the housing.

7. The sheet-shaped-medium feeder according to claim 6, wherein the second air outlet is an opening having a lower end located below lower ends of the first air outlets.

8. The sheet-shaped-medium feeder according to claim 1, wherein the second air outlet is disposed out of a side portion of the housing.

9. The sheet-shaped-medium feeder according to claim 1, wherein the second air outlet includes an inner second air outlet disposed inside the housing, and an outer second air outlet disposed out of the side portion of the housing.

10. The sheet-shaped-medium feeder according to claim 9, wherein the inner second air outlet and the outer second air outlet are integrated with or connected to trailing ends of bifurcate portions obtained by bifurcating a fan duct.

11. The sheet-shaped-medium feeder according to claim 1, wherein the second air outlet is an opening having a lower end located below lower ends of the first air outlets.

12. The sheet-shaped-medium feeder according to claim 1, wherein the second air outlet is a vertically long opening.

13. The sheet-shaped-medium feeder according to claim 1, further comprising:

left and right side walls that come into contact with left and right edges of the long sheet-shaped media stacked on the extended portion to guide the left and right edges moving in the transportation direction, wherein the second air outlet is formed in one of the left and right side walls, and wherein the other one of the left and right side walls is a plate member extending in the transportation direction.

14. The sheet-shaped-medium feeder according to claim 1, wherein the long mount portion includes a dedicated mount portion disposed inside a container, and an additional mount portion added to an end portion of the dedicated mount portion upstream in the transportation direction.

15. The sheet-shaped-medium feeder according to claim 1, wherein the long mount portion serves as a replacement mount portion attached in place of a dedicated mount portion disposed inside a container.

16. A sheet-shaped-medium handling apparatus, comprising:

a sheet-shaped-medium feeder that separates, transports and feeds sheet-shaped media that are stacked; and a processing device that performs processing on the sheet-shaped media fed from the feeder, wherein the sheet-shaped-medium feeder includes the sheet-shaped-medium feeder according to claim 1.

* * * * *